US009355830B2

(12) United States Patent
Baykut et al.

(10) Patent No.: US 9,355,830 B2
(45) Date of Patent: May 31, 2016

(54) INTRODUCTION OF IONS INTO ION CYCLOTRON RESONANCE CELLS

(71) Applicant: Bruker Daltonik GmbH, Bremen (DE)

(72) Inventors: Gökhan Baykut, Bremen (DE); Roland Jertz, Bremen (DE)

( * ) Notice: Subject to any disclaimer, the term of this patent is extended or adjusted under 35 U.S.C. 154(b) by 0 days.

(21) Appl. No.: 14/489,591

(22) Filed: Sep. 18, 2014

(65) Prior Publication Data

US 2015/0102217 A1 Apr. 16, 2015

(30) Foreign Application Priority Data

Oct. 2, 2013 (EP) ..... 13004771

(51) Int. Cl.

| | |
|---|---|
| ***H01J 49/34*** | (2006.01) |
| ***H01J 49/06*** | (2006.01) |
| ***H01J 49/22*** | (2006.01) |
| ***H01J 49/38*** | (2006.01) |
| ***H01J 49/42*** | (2006.01) |
| ***H01J 49/00*** | (2006.01) |
| ***H01J 49/26*** | (2006.01) |

(52) U.S. Cl.

CPC ..... *H01J 49/062* (2013.01); *H01J 49/0031* (2013.01); *H01J 49/22* (2013.01); *H01J 49/26* (2013.01); *H01J 49/38* (2013.01); *H01J 49/426* (2013.01)

(58) Field of Classification Search

USPC ..... 250/396 R, 397, 281, 282, 290, 291, 250/293, 298, 299

See application file for complete search history.

(56) References Cited

U.S. PATENT DOCUMENTS

| | | | | |
|---|---|---|---|---|
| 4,924,089 | A | 5/1990 | Caravatti | |
| 4,990,775 | A | 2/1991 | Rockwood et al. | |
| 2006/0169892 | A1 * | 8/2006 | Baba | H01J 49/005 250/292 |
| 2009/0032696 | A1 | 2/2009 | Dahl et al. | |

FOREIGN PATENT DOCUMENTS

| | | | |
|---|---|---|---|
| DE | 102009050039 | A1 | 4/2011 |
| WO | 2012053799 | A1 | 4/2012 |

* cited by examiner

*Primary Examiner* — Nicole Ippolito
(74) *Attorney, Agent, or Firm* — Benoit & Cote, Inc.

(57) ABSTRACT

The invention relates to a method and a device for introducing ions into an ICR cell of Fourier transform ion cyclotron resonance mass spectrometers, in particular with a reduced the magnetron orbit. The invention is based on applying at least one gated DC voltage to a mantle electrode of the ICR cell prior to the excitation of the cyclotron motion such that injected ions are deflected inside the ICR cell in at least one radial direction.

15 Claims, 16 Drawing Sheets

600

610

INTRODUCTION OF IONS INTO ION CYCLOTRON RESONANCE CELLS

BACKGROUND OF THE INVENTION

1. Field of the Invention

The invention relates to methods and devices for introducing ions into a measuring cell of a Fourier transform ion cyclotron resonance mass spectrometer (FT-ICR MS), in particular for reducing the magnetron orbit of ions introduced into the ICR cell.

2. Description of the Related Art

In a magnetic field with the flux density B, an ion with the mass m, the elementary charge e and the charge number z performs a circular motion (cyclotron motion) in the radial plane perpendicular to the magnetic field lines with the well-known cyclotron frequency:

$$\nu_c = \frac{zeB}{2\pi m} \tag{1}$$

The cyclotron radius $r_c$ of an ion with the mass m, the elementary charge e, the charge number z, and the kinetic energy $E_{kin}$ in a magnetic field of the flux density B is given by the following equation:

$$r_c = \frac{\sqrt{2mE_{kin}}}{zeB} \tag{2}$$

In the thermal energy range, e.g., at a temperature of 298 K, and in a magnetic field with the flux density of 7 Tesla, the cyclotron radius of a singly charged ion with mass 1,000 Dalton is approximately a tenth of a millimeter.

The magnetic field can only trap ions in the plane perpendicular to the magnetic field lines. To prevent the ions from escaping in the axial direction, an electric trapping field is required, which can be generated, e.g., in a cylindrical ICR cell. A simple conventional cylindrical ICR cell contains, axially, at both ends of the cell, end electrodes (or end plates), on which a relatively low DC voltage (normally, 1-2 volts) is applied. The polarity of this DC voltage is the same as the ions to be trapped. The cylinder mantle electrodes of such a simple ICR cell are grounded, thus, an electric trapping field is formed in the ICR cell between the end electrodes and the cylinder mantle. Ions with the mass m and the charge number z oscillate axially in the ICR cell of the length a between the two end electrodes with a trapping frequency $\nu_T$ if a trapping voltage $V_T$ is applied:

$$\nu_T = \frac{1}{2\pi}\sqrt{\frac{2\alpha zeV_T}{ma^2}} \tag{3}$$

Here e is the elementary charge, and $\alpha$ a constant depending on the ICR cell geometry. With this additional oscillation the ion performs a combination of three independent periodic motions in the ICR cell: cyclotron and magnetron motions in the radial plane, and the trapping oscillations in the axial direction.

In the presence of a trapping field, the frequency measured at the detection electrodes of the ICR cell is no longer the unperturbed cyclotron frequency $\nu_c$ but the reduced cyclotron frequency $\nu_R$:

$$\nu_R = \frac{\nu_c}{2} + \sqrt{\frac{\nu_c^2}{4} - \frac{\nu_T^2}{2}}, \tag{4}$$

which is smaller by a magnetron frequency $\nu_M$ than the unperturbed cyclotron frequency:

$$\nu_R = \nu_c - \nu_M \tag{5}$$

The magnetron frequency of an ion of cyclotron frequency $\nu_c$ and a trapping frequency $\nu_T$ is:

$$\nu_M = \frac{\nu_c}{2} - \sqrt{\frac{\nu_c^2}{4} - \frac{\nu_T^2}{2}} \tag{6}$$

FIG. 1 shows the combined motion of an ion in an ICR cell in the magnetic field of the flux density B (1). The combination of the reduced cyclotron motion (2), the trapping oscillation (3), of which the sinusoidal curve is shown in dashed lines (4), and the magnetron motion (5) produces the complicated resulting motion (6) of the ion around the electric field axis (7).

When an ion is axially introduced exactly in the middle of the ICR cell, it will not experience any electric field component perpendicular to its path. The radial components of the electric trapping field are distributed symmetrically around the axis of the DC electric field, i.e. around the axis of the ICR cell. Thus, there is no perpendicular electric field component on the cell axis. However, an ion which is not introduced on axis into the ICR cell experiences a perpendicular electric field component, and the influence of the E×B fields immediately diverts it from its initial path. The ion now drifts perpendicular to both the magnetic field and that radial electric field component into the third dimension and starts an epicycloidal orbit that winds on a circle around the electric field axis. This is a magnetron orbit around the cell axis.

Although the applied electric trapping field helps keeping the ions from escaping the ICR cell, it definitely deteriorates the conditions for a clean measurement of the cyclotron frequency. Due to the radial components of the electric trapping field, the ions do not only circle on their pure cyclotron orbits. As a superimposed motion they follow epicycloidal magnetron orbits and they additionally oscillate in the axial direction with the trapping frequency. The magnetron motion is very slow compared to the cyclotron motion. Its frequency only depends on the magnetic field and the electric field. The size (or diameter) of the initial magnetron orbits of ions in the ICR cell right after they are captured depends on how the ions are transferred to the ICR cell, e.g., whether they are transferred by an electrostatic ion transfer optics or by an RF-multipole transfer optics, or whether or not they are captured using an electric field pulse ("sidekick") orthogonal to their path and to the magnetic field etc.

Normally, the ICR cell contains a large number of ions, and their masses can be quite different. Before detection, the reduced cyclotron motion of the ions is excited by an oscillating (RF) electric field with a scanned frequency ("Chirp"). When the frequency of the scanned oscillating field becomes equal to the reduced cyclotron frequency (equation 4), its cyclotron motion gets resonantly excited. Depending on the duration and the amplitude of the oscillating (RF) electric field, ions become accelerated and move to larger (excited) cyclotron orbits. This resonant excitation also forces ions with the same charge number-related mass (m/z), which initially circle randomly on small cyclotron orbits having completely different phases, to a coherent motion. At the end of the excitation process ions with the same charge number-related mass (m/z) form a cloud in which these ions move in phase. Coherently moving ions in the cloud induce image charges at the detection electrodes that oscillate with the same frequency and with the same phase. Such oscillating image charges (image currents) generated by all ion clouds are detected, amplified, and after Fourier transformation displayed as a frequency spectrum or, when a frequency to mass mapping (calibration) exists, as a mass spectrum.

One intrinsic property of the (fast) Fourier transform detection method is the appearance of higher harmonic frequencies for each fundamental frequency signal in the frequency spectrum. In the ideal case of a perfectly symmetric electric field, and if the ions are injected in the middle into the ICR cell, only odd-numbered harmonic frequencies should appear in the spectrum due to a pure cyclotron motion around the center of the ICR cell. The intensities and distribution of the odd-numbered harmonics depend on the ion cyclotron radius and the arrangement of the detection electrodes. Any distortion/asymmetry of the electric field or improper injection of an ion packet into the ICR cell, however, entails a magnetron motion of the ions in the ICR cell. In such case, additional even-numbered harmonic frequencies of the main or fundamental ion signal appear in the spectrum.

A large magnetron orbit of ions captured in an ICR cell (negatively) influences the cyclotron excitation process of the ions and their detection. It also impairs the detected signal, leads to an increase of the intensity of the peaks associated with the even-numbered (e.g., second) harmonics in the Fourier transformed spectrum and to more abundant sidebands of the ion signal. In extreme cases, ions can be lost during the cyclotron excitation when they are on large magnetron orbits that are critically close to the cylinder mantle electrodes.

Additionally, a large magnetron orbit can cause problems when using a so-called multiple frequency detection method. Multiple frequency detection multiplies the resolving power of the detected mass peaks. In an ICR cell multiple frequency signals can be obtained if more than two detection electrodes (e.g., 4, 8, etc.) are used. However, this method can only be successfully applied if ions have no magnetron orbits or if they are vanishingly small. Moderate or large magnetron orbits severely complicate the ICR mass spectra and reduce the signal intensity of the multiple-frequency mass peaks.

The as yet unpublished U.S. patent application Ser. No. 13/767,595 of G. Baykut, J. Friedrich, R. Jertz, and C. Kriete, the content of which is herewith incorporated by reference in its entirety, relates to a method for detecting position (center) and size of the initial magnetron orbit of ions captured in an ICR cell. In this method, parameters indicative of position and size of the magnetron motion for an ion with a reduced cyclotron frequency $\nu_R$ in the ICR cell are determined by monitoring relative intensities (relative to the intensity of the main or fundamental peak with frequency $\nu_R$) of at least one of the ion signals with frequencies of $(2n\nu_R \pm m\nu_M)$, n=1, 2, 3, . . . , and m=0, 1, 2, 3, 4, . . . , as a function of the time delay between ion injection and cyclotron excitation (post capture delay, PCD), and by evaluating maxima and minima of the relative intensities. The ± sign indicates that either a satellite peak being shifted to higher frequencies or to lower frequencies can be monitored wherein two or more of these satellite peaks can be monitored.

U.S. patent application Ser. No. 13/767,595 also teaches that, if the cyclotron excitation is initiated at a selected PCD time, the magnetron orbit can be reduced, since the PCD time defines the position (=phase) of the ion on its magnetron orbit. At a certain PCD time the cyclotron excitation simultaneously excites the ion's magnetron orbit too, at others the cyclotron excitation leads to reduction of its magnetron orbit. However, reducing the magnetron radius in dependence of the PCD time, which is in some cases quite long, restricts the operations of the FT-ICR mass spectrometer with fast pre-separation techniques, such as a liquid chromatographic separator.

Ions which are generated in external ion sources need to be introduced into the ICR cell for analysis. The pulsed transfer of ions from ion sources or from intermediate ion storage or accumulation devices to the ICR cell includes an extraction and injection event. The flight of the ions to the ICR cell takes an m/z-dependent time (time of flight): When accelerated to the same kinetic energy lighter ions arrive earlier at the ICR cell, heavier ones fly slower and arrive later. Therefore, the extraction and injection pulse defines an injection period $\Delta t_{in}$ during which all transferred ions enter the ICR cell.

Ions which are generated in external ion sources and which are electrostatically injected into the ICR cell, as the case may be exactly on the cell axis without velocity components perpendicular to the magnetic field, may not be successfully captured in the cell. They can fly through and may exit the ICR cell at the other end. An invention by P. Caravatti (U.S. Pat. No. 4,924,089 A) describes a technique to efficiently capture externally generated ions in the ICR cell. This technique basically uses two fixed electrodes at the ICR cell entrance to apply a transversal electric field during the period of ion introduction. This electric field is perpendicular to the ion path and to the magnetic field, and it tries to divert ions from their path parallel to the magnetic field ("sidekick"). As the ions obtain velocities perpendicular to the magnetic field the Lorentzian force makes them circle on cyclotron orbits, which also lead to magnetron motions due to the radial trapping field components in the ICR cell. In doing so, the simple and straight flight of the ion through the ICR cell and the escape at the other end is effectively avoided.

This method by Caravatti provides the ions introduced into the ICR cell with a velocity component perpendicular to the magnetic field, however there is no complete control over the motion of the ions inside the ICR cell due to following reasons: (i) The transversal electric field effecting the "sidekick" is substantially located outside the ICR cell; and (ii) The ions are "side-kicked" up or down, i.e. along one fixed radial direction, since the two electrodes have fixed configuration. The configuration of the "side-kick" electrodes and the trapping plate near the sidekick electrodes generates an asymmetric electric field which can increase the magnetron motion in the ICR cell.

Another method often used for introducing ions into an ICR cell is the dynamic trapping of ions. In this case, the voltage at the entrance side trapping plate is reduced and the voltage of the other trapping plate is significantly increased. A more complex version of this method is the gas-assisted dynamic trapping of ions. A pulse of collision gas (such as nitrogen or argon) is injected into the cell, which is commonly kept at ultrahigh vacuum, and takes off the excessive kinetic energy and thus reduces the cyclotron orbit size, however on the expense of increasing the magnetron orbit. A quadrupolar excitation of ions in the ICR cell combined with a pulsed collision gas can reduce the magnetron motion. This method makes use of the periodic interconversion of the magnetron and cyclotron motions in the quadrupolar excitation field.

All methods using a pulsed gas have also the disadvantage that the mass spectrometric system is not ready to acquire a highly resolved mass spectrum until the additional gas is substantially pumped away. The continuous application of the pulsed gas method has the further disadvantage of slowly increasing the background pressure.

For an efficient ion injection, the methods described above require a pulsed ion transfer from an external source or from a storage device on the way to the ICR cell. A package of ions is transferred and injected into the ICR cell during a certain time, the injection period $\Delta t_{in}$, which is defined by the kinetic energy of the ions and the m/z range of ions of interest. Only during this time period, an electric ion capturing process is applied. If the duration of this capturing process exceeds the actual ion injection period it may lead to loss of ions: In case of the dynamic trapping, the ions of interest could escape the ICR cell if the voltage at the entrance trapping plate is still low. In case of the sidekick method, a permanent application of the sidekick voltages would distort the geometry of the electrical trapping field inside the ICR cell during the ion detection.

Externally generated ions are usually transferred to the ICR cell either using an electrostatic ion transfer system or an RF multipole ion guide. In both of the cases, they may pick up a radial motion in the magnetic fringe fields due to the fact that the ions need to enter a magnetic field during their transfer to the ICR cell. As a consequence, the ions enter the ICR cell with an initial cyclotron motion. The ion injection position at the entrance of the ICR cell could be off the cell axis, which further introduces an initial magnetron motion. Additionally, it is also known that RF multipole ion guides that are used for ion transfer into ICR cells cause a radial displacement of the ion motion during their travel to the ICR cell due to the superposition of the RF electric and magnetic fields. This also leads to an offset ion entrance into the ICR cell and, thus, to an initial magnetron motion.

FIG. 7A shows an example of a dynamically harmonized ICR cell (50), known from the patent application WO 2011/045144 A1 (E. Nikolaev and I. Boldin). This ICR cell has two end electrodes (trapping electrodes 80 and 81), leaf-shaped (e.g., 58) and inverse leaf-shaped (e.g., 55, 57, 59, 61) cylinder mantle electrodes. The leaf-shaped electrodes are connected to ground potential, all inverse leaf plates may be supplied with a common variable DC voltage (DC bias) which normally does not differ too much from the trapping voltage of the end electrodes (80 and 81) of the ICR cell. The reference sign X denotes the cell axis. In order to divide the cell mantle into four equal 90° segments, four of the eight leaf electrodes are longitudinally divided into two halves (e.g. 56*a* and 56*b*). Thus the ICR cell has four integral leaf electrodes, four split leaf electrodes, and eight inverse leaf electrodes. The dashed line (10) on the cell indicates the z-position of the cut for the cross-sectional view in FIGS. 7C, 7D, and 7E.

FIG. 7B (prior art) displays the cylinder mantle electrodes open and unwound. There are two excitation segments E consisting of 5 electrodes (60*b*, 61, 62, 63, 64*a*) and (69*b*, 70, 71, 72, 56*a*). Furthermore, there are two detection segments D consisting of 5 electrodes (56*b*, 57, 58, 59, 60*a*) and (65*b*, 66, 67, 68, 69*a*). In the detection segments often only the leaf and half leaf electrodes (56*b*, 58, 60*a*) and (65*b*, 67, 69*b*) are used. The inverse leaf electrodes (57, 59, 66 and 68) are normally not used as detection electrodes since these are connected to DC voltage power supplies and thus lead to noisy ICR signals. However, if the DC voltages are generated by a battery, the noise can be avoided, and all five electrodes in a detection segment can be used for signal detection.

FIG. 7C (prior art) shows a cross sectional view of the dynamically harmonized cell (50) cut at the position indicated by the dashed line (10) in FIG. 7A, including a simplified wiring scheme for the connection of DC bias voltages. Basically, all inverse leaf electrodes can be connected to one single DC voltage source. In this example, instead of one common DC voltage source, four independent DC voltage sources 40, 41, 42, and 43 are used, which may all generate the same DC bias. Each source is connected to a pair of inverse leaf electrodes: The source 41 is connected to electrodes 53 and 55, the source 40 to electrodes 57 and 59, the source 43 to electrodes 61 and 63, the source 42 to electrodes 65 and 67. Individual sources have the advantage of independently varying the DC bias voltages in order to apply a field correction as known from U.S. patent application Ser. No. 13/767,595.

In the dynamically harmonized ICR cell the ions experience a harmonic potential averaged over a cyclotron cycle. The dynamic harmonization is most efficient if the magnetron orbit is small. The invention in U.S. patent application Ser. No. 13/767,595 enables a correction of the offset radial electric field and thus forms an on-axis magnetron motion. Furthermore, it helps reduce the magnetron motion using a post capture delay (PCD). This may introduce extended times for each FT-ICR acquisition which are not appreciated when doing LC-MS. Therefore, large initial magnetron orbits of ions need a more efficient way to be reduced.

In view of the foregoing, an efficient method is needed to quickly introduce and capture external ions in the ICR cell without inducing a large magnetron motion. A new method should be able to efficiently introduce and capture ions in the ICR cell and reduce or minimize their magnetron motions, in the best case even such that the magnetron motions substantially disappear.

SUMMARY OF THE INVENTION

In a first aspect, the present invention provides a method for injecting ions into an ICR cell with mantle electrodes arranged along the axis of the cell, wherein a gated DC voltage is applied to a mantle electrode of the ICR cell such that injected ions are deflected inside the FT-ICR cell in a radial direction.

In a first embodiment, at least two gated DC voltages are each applied to different mantle electrodes such that the deflection of the injected ions is adaptable to any radial direction. The ICR cell can be a dynamically harmonized ICR cell with leaf and inverse leaf electrodes as shown in FIGS. 7A, 7B and 7C. In a dynamically harmonized cell at least two gated DC voltages can be applied to different inverse leaf electrodes. However, the ICR cell can also be a conventional ICR cell with mantle electrodes which are separated from each other by parallel and optional azimuthal slits wherein the gated DC voltages are applied to two different of these mantle electrodes.

In a second embodiment, the gated DC voltages applied to mantle electrodes are adjusted such that the signal intensity of at least one even-numbered harmonic peak with the frequencies of $2n\nu_R \pm m\nu_M$ (with n=1, 2, 3, . . . and m=1, 2, 3, . . . ) becomes minimal. The signal intensity of at least one even-numbered harmonic peak with the frequencies of $2n\nu_R \pm m\nu_M$ (with n=1, 2, 3, . . . and m=1, 2, 3, . . . ) can also be reduced by varying a post capture delay time prior or after adjusting the gated DC voltages, e.g., with respect amplitude (height and variation in time) and duration (start and end point). Minimizing the signal intensity of even-numbered harmonic peaks results in a reduced magnetron orbit of ions captured in the ICR cell.

The gated DC voltage(s) are preferably applied prior to a cyclotron excitation of the injected ions. The duration of the gated DC voltage(s) can partially or fully overlap with the injection period of the ions into the ICR cell. The gated DC voltage(s) can also be applied after the injection of the ions into the ICR cell and prior to the cyclotron excitation of the ions. The duration of the gated DC voltage is preferably between 100 μs and 5 ms, most preferably about 1 ms. The amplitude of the gated DC voltage(s) are preferably between 0.1 volts and 5 volts, most preferably about 1.5 volts. Furthermore, the amplitude of the gated DC voltage(s) can vary in time while it is applied to the respective mantle electrode.

In a second aspect, the invention provides an ICR cell with mantle electrodes arranged along the axis of the cell, comprising at least two gated DC voltage sources that are each connected to different mantle electrodes and that are configured to generate a radial deflection field inside the cell and to remove the deflection field prior to the excitation of the ions. Therefore, a two-dimensional control over the velocity components of the ions can be obtained when the ions are entering the ICR cell.

In a first embodiment, the ICR cell is a dynamically harmonized ICR cell with leaf and inverse leaf electrodes and wherein the gated DC voltage sources are each connected to different inverse leaf electrodes. At least one inverse leaf electrode can also be segmented longitudinally wherein one of the gated DC voltage sources is connected to a segment of the inverse leaf electrode such that a single segment is provided with an individual gated DC voltage. Some of the leaf electrodes may be split parallel to the axis of the cell. The adjacent inverse leaf electrodes or longitudinal segments of adjacent inverse leaf electrodes can further be electrically connected to groups wherein each group is jointly connected to one of the gated DC voltage sources, i.e., that for example a pair of inverse leaf electrodes or a pair of segments of two inverse leaf electrodes are provided with the same gated DC voltage. Each group may comprise two or more connected inverse leaf electrodes or longitudinal segments of inverse leaf electrodes.

In a second embodiment, the ICR cell comprises excitation and detection electrodes and wherein a first gated DC voltage source is connected to one or all excitation electrodes and a second gated DC voltage is connected to one or all detection electrodes. The excitation electrodes as well as the detection electrodes can be electrically connected with each other. For example, the excitation electrodes can be grouped in two or more pairs of adjacent excitation electrodes and the detection electrodes are grouped in two or more pairs of adjacent detection electrodes. The excitation electrodes and/or the detection electrodes can be longitudinally segmented wherein gated DC voltages sources can be electrically connected to at least one of the longitudinal segments.

In a conventional ICR cell with four cylinder mantle electrodes, all four mantle electrodes can be connected to four gated DC voltage source such that gated DC voltages are applied to the mantle electrodes during the introduction time of the ions. By individually varying the gated DC voltages applied to the four mantle electrodes, a two-dimensional control over the velocity components of the ions can be obtained when the ions are entering the ICR cell.

Prior to the excitation of cyclotron motion, the gated DC voltages at the corresponding mantle electrodes are preferably replaced by substantially static DC voltages for the known operation of the ICR cell. If electric field symmetry corrections are desired as described in U.S. patent application Ser. No. 13/767,595 corresponding correction voltages can be applied to individual cylinder mantle electrodes.

In the present invention, the gated deflection voltages are applied to mantle electrodes of an ICR cell so that ions are deflected within the ICR cell in a radial direction in order to reduce their magnetron orbits. Using multiple mantle electrodes for deflection (e.g., four) enables the deflection of the ions in all directions in the radial plane perpendicular to the ICR cell axis and provides a control over the radial motion. The invention by P. Caravatti (U.S. Pat. No. 4,924,089 A) describes a "sidekick" technique to capture ions in the ICR cell. This technique uses two electrodes at the entrance hole of the ICR cell. By applying a pulsed voltage to the two electrodes outside of the ICR cell, ions obtain velocity components perpendicular to the magnetic field. They start diverting in direction of the applied electric field and their velocities in direction of the magnetic field become reduced. These two electrodes can provide an electric force in only one dimension and cannot controlledly influence the magnetron orbits of the ions.

It has been observed that the sidekick capture according to Caravatti increases not only the cyclotron radius but also the magnetron orbit size, because ions accelerated radially by the sidekick electrodes enter the cell off-axis and experience the radial electric field components. The Caravatti method decreases the axial velocity components of ions by increasing their radial velocity components. In contrast, the present invention is directed to decrease the radial velocity components, and the axial velocity components of the ions in the ICR cell might even be increased.

BRIEF DESCRIPTION OF THE DRAWINGS

patent application Ser. No. 13/767,595.

DETAILED DESCRIPTION

The present invention aims at reducing the initial magnetron orbit of ions captured in the ICR cell by deflecting the ions in the ICR cell during the injection period.

The existence of the magnetron motion in the ICR cell normally produces weak sidebands around the main ion cyclotron resonance signal of an ion measured at the frequency $\nu_R$ which are visible on the frequency scale in a distance of the magnetron frequency $\nu_M$ and $2\nu_M$. Additionally, in the mass spectrum a peak with half the mass, i.e., with the doubled reduced cyclotron frequency $2\nu_R$ can appear when the magnetron orbit center is not the ICR cell axis center. This is the second harmonic peak, its abundance being directly related to the displacement of the magnetron orbit center and ICR cell axis. This can happen when the electric trapping field axis is shifted in respect to the ICR cell axis. Another signal with comparable abundance appears next to the $2\nu_R$ signal, which is a satellite peak with a frequency of $(2\nu_R+\nu_M)$. This satellite peak is separated from the second harmonics peak by just one magnetron frequency $\nu_M$. The abundance of this satellite peak is directly related to the location of the ion in the cell at the start of the cyclotron excitation, i.e., it depends on the size and position of the initial magnetron orbit. Depending on conditions, other satellite signals with even less abundance can also appear in distances of $m\nu_M$ (m=2, 3, 4, . . . ), which usually are not of significant abundance under regular measurement conditions. However, they basically can also be used as a measure for reducing the magnetron orbit reduction if they are sufficiently abundant. In regular frequency spectra or mass spectra these distances are extremely small since the magnetron frequency $\nu_M$ is, in general, on the order of 10 Hz under the electric and magnetic field conditions frequently applied.

Figure 4A:
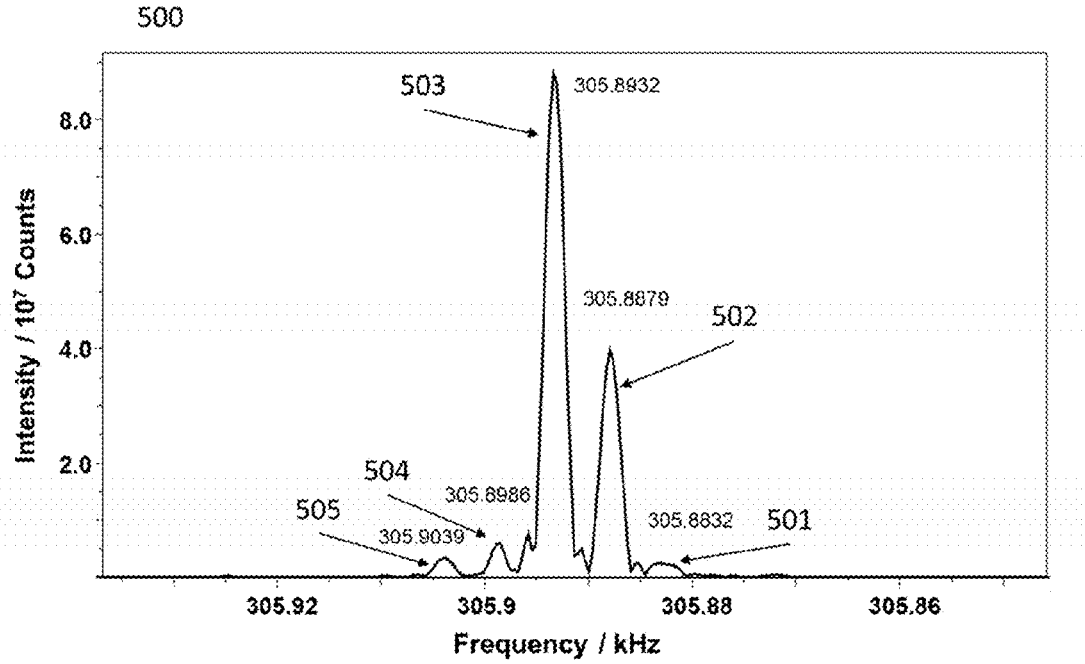
FIG. 4A shows a selected second harmonic peak group on a frequency scale from a NaTFA spectrum (m/z 702 peak selected), without any electric field correction or gated deflection in the FT-ICR cell.

The intensity of the second harmonic peak with the frequency of $2\nu_R$ is basically related to a magnetron motion where the center of the magnetron orbit is not the ICR cell axis. If the magnetron orbit center is on the center axis of the ICR cell, the second harmonic peak with the frequency of $2\nu_R$ will not appear due to an averaging effect: the detection time is almost always much longer than one magnetron cycle so that, when an ion is detected, several magnetron cycles are averaged. If the center of the magnetron orbit approaches the cell axis, the intensity of the second harmonic is reduced. If the magnetron orbit axis coincides with the cell axis, the second harmonic peak disappears. The abundance of the satellite peak with the frequency $2\nu_R+\nu_M$ is directly related to the location of the ion in the cell at the start of the cyclotron excitation, i.e., it depends on the size of the initial magnetron orbit and its position in the cell. If the magnetron radius is large, the satellite peaks are considerably abundant, as shown in FIG. 4*a*.

In an FT-ICR measurement, it is advantageous if the magnetron orbit has a relatively small diameter or if it does not exist at all. Unfortunately, experimental methods to reduce the magnetron motion with cooling using a resonant buffer gas are not generally applicable since they are mass selective and require the introduction of relatively high amounts of gas into the ultrahigh vacuum chamber. In addition, it is also desirable that the axis of the magnetron orbit be as close as possible to the axis of the ICR cell or coincides with it. A compromise would be a very small magnetron orbit that is very close to the cell axis. If the electric field in the cell is asymmetric, its axis may be radially displaced against the cell axis. In this case, the magnetron orbit axis is also radially displaced against the ICR cell axis.

Simulations of the ion motion in ICR cells show, if the electric field axis does not coincide with the cell axis, i.e., if it is radially displaced, the second harmonic peak with the frequency $2\nu_R$ appears. This would also be a sign that the magnetron orbit is not concentric with the cell, i.e., that its center is off the cell axis. On the other hand, the intensity of the satellite peak $(2\nu_R+\nu_M)$ of the second harmonic increases also with the magnetron radius. In order to achieve small and axial magnetron orbits, in an embodiment according to the electric field correction, as described in the U.S. patent application Ser. No. 13/767,595, it is proposed to correct or compensate for electric field conditions by using static compensation voltages applied to cylinder mantle electrodes so that the intensities of the second harmonic and its satellite peak become as small as possible.

According to the present invention, the electrodes used for deflecting ions to lower magnetron circles prior to their cyclotron excitation, in particular during the injection into the cell, can be the same cylinder mantle electrodes which are used in common operation of the cell or the ones used for the correction of the offset radial electric field or any electric field asymmetries as described in the U.S. patent application Ser. No. 13/767,595. However, dedicated extra electrodes can also be installed and used for the deflection of ions in order to reduce the magnetron radii.

Simulation of ion motion also shows that during the cyclotron excitation process of an ion which is not at the cell axis, the center of the cyclotron motion shifts radially. If the ion is off the cell axis and closer to an excitation electrode at the start of the cyclotron excitation, the center of its cyclotron path drifts away from the excitation electrode towards the axis of the cell during the cyclotron excitation. This means that, after the cyclotron excitation, the ion will continue orbiting on a slightly smaller magnetron orbit. The magnetron motion is de-excited or relaxed. If, however, at the start of the cyclotron excitation, the ion is off the cell axis and closer to a detection electrode, the center of its cyclotron path drifts in direction to the detection electrode, away from the axis of the cell. This means that, after this cyclotron excitation, the ion continues circling on a larger magnetron orbit. Its magnetron motion is excited during the cyclotron excitation period. An increase of the size (or diameter) of the magnetron orbit leads to a stronger satellite peak $(2\nu_R+\nu_M)$ of the second harmonic $2\nu_R$. Thus, in a complete magnetron cycle around the cell axis there are two phases where a cyclotron excitation increases the intensity of the satellite peak $(2\nu_R+\nu_M)$ and two phases where a cyclotron excitation decreases the intensity of the satellite peak $(2\nu_R+\nu_M)$.

Compared to the cyclotron motion, the magnetron motion is very slow. Thus, when an ion is cyclotron-excited on its magnetron orbit, after the excitation, the ion practically does not move further on its magnetron path. If a variable delay (post capture delay, PCD) is inserted between the capture of the ion in the cell and the excitation of the cyclotron motion in the experiment sequence, the ion motion can be monitored on the magnetron orbit by the satellite peak ($2n\nu_R+m\nu_M$) of an even-numbered harmonics, such as the second harmonic with n=1. If after a certain post capture delay time the ion arrives in the quadrant of a detection electrode, at which point the resonant cyclotron excitation takes place, the monitored intensity of the ($2\nu_R+\nu_M$) peak increases to a maximum. After a still larger post capture delay time, if the ion arrives in the quadrant of an excitation electrode when the resonant cyclotron excitation takes place, the monitored intensity of the ($2\nu_R+\nu_M$) peak decreases to a minimum.

The measured dependence of the relative intensity of the ($2\nu_R+\nu_M$) peak on the post capture delay (PCD) can be used to obtain information about the size and the displacement (or shift) of the magnetron orbit and about the symmetry of the DC electric field in the cell. If the change of the relative intensity of the peak with the measured frequency ($2\nu_R+\nu_M$) is plotted as a function of the post capture delay of the ions in the cell, an oscillating curve is obtained, which we call in the following a PCD curve or a PCD diagram (see U.S. patent application Ser. No. 13/767,595). These curves usually show two maxima and two minima within a magnetron period. PCD diagrams of ions on magnetron orbits around the cell axis show two equally high maxima and two equally high minima within one magnetron period. If the maxima are not equally high, this is a sign that the magnetron orbit is shifted, i.e., that the electric field axis does no longer coincide with the cell axis. Relatively small magnetron orbits result in flat and shallow PCD curves with low intensity. Larger magnetron orbits are responsible for the higher maxima and deeper minima. Magnetron orbits which are shifted completely to one side of the cell result in PCD curves with one single maximum and one single minimum within a magnetron period. Very small magnetron orbits which are completely off axis and shifted to a quadrant of the cell, which however, due to their small size still are very close to the cell axis, form flat PCD curves with a single maximum and a single minimum within a magnetron period and still deliver good FT-ICR spectra. It has to be noted that the relative intensity of the ($2\nu_R+\nu_M$) peak changes often very strongly with the variation of the post capture delay, while the relative intensity of the second harmonic $2\nu_R$ shows no significant change versus the variation of the post capture delay time.

Figure 1:
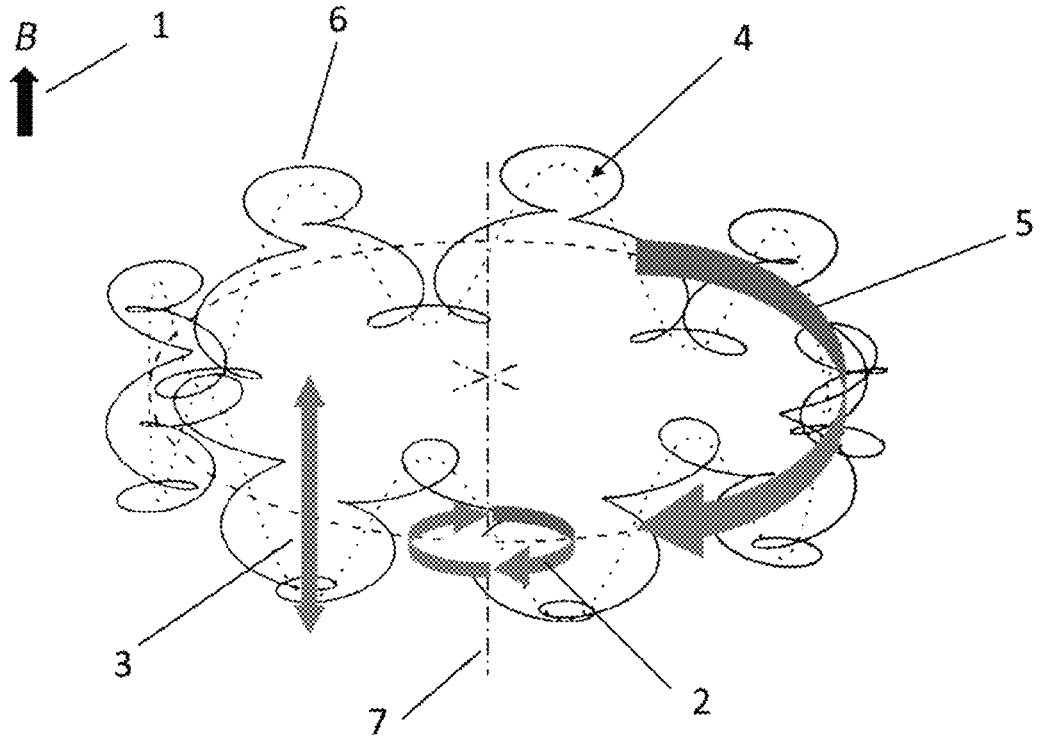
FIGURE 1 (PRIOR ART)
FIG. 1 shows the well-known combined motion of the ions in an ICR cell as basis for the description of the principles of the invention.
Figure 2A:
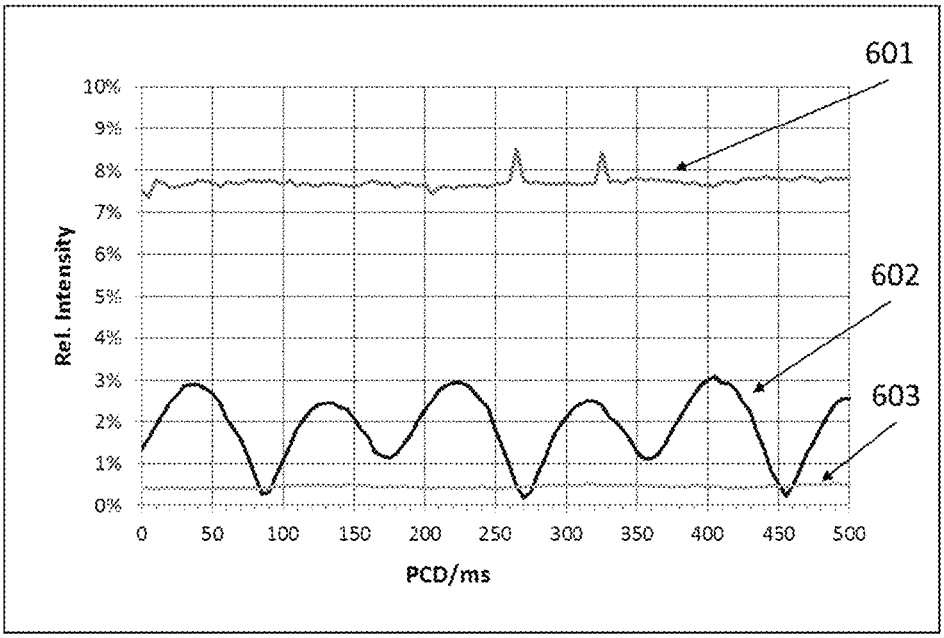
FIG. 2A shows a measured PCD curve of the third harmonic peak with the frequency $3\nu_R$ and the second harmonic peaks with frequencies $2\nu_R$ and $(2\nu_R+\nu_M)$ after the corrections of electric field asymmetries as described in U.S. patent application Ser. No. 13/767,595.

FIG. 2A shows a post capture delay (PCD) diagram (600) with the plot of the third harmonic peak curve (601) with the frequency $3\nu_R$ and the plot of the second harmonic peak curve (603) with the frequency of $2\nu_R$, as well as the abundant satellite peak curve (602) of the second harmonic with the frequency of ($2\nu_R+\nu_M$) after the electric field asymmetry corrections as described in U.S. patent application Ser. No. 13/767,595. However, in these experiments no gated deflection voltages were applied during the injection of ions into the ICR cell for minimization of magnetron orbit size. The oscillating curve (602) of the peak with the frequency of ($2\nu_R+\nu_M$) shows peak-to-peak amplitudes up to 3% of the signal with the frequency $\nu_R$.

Figure 2B:
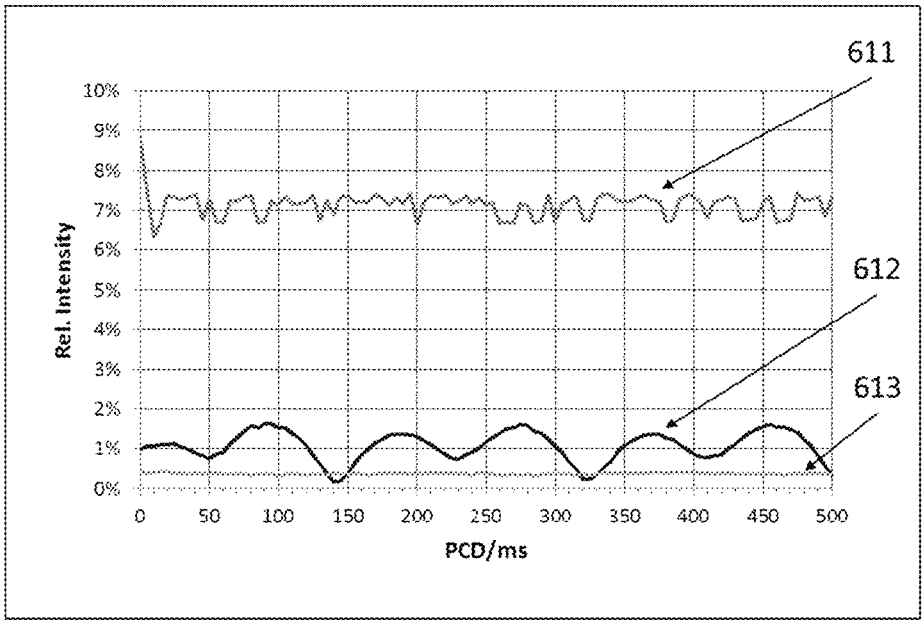
FIG. 2B shows a measured PCD curve of the third harmonic peak with the frequency $3\nu_R$ and the second harmonic peaks with frequencies $2\nu_R$ and $(2\nu_R+\nu_M)$ after the additional reduction of the initial magnetron motion as described in this disclosure.

The diagram (610) in FIG. 2B shows the PCD curves of the electric field asymmetry-corrected plots after the additional application of the gated deflection voltages, as described above. Depicted are the curve of the third harmonic (611) with the frequency $3\nu_R$ and the second harmonic (613) with the frequency $2\nu_R$ and its major satellite peak (612) with the frequency $2\nu_R+\nu_M$ after the reduction of the initial magnetron motion by applying the gated deflection voltages during the injection of ions. The oscillating curve (612) of the peak with the frequency $2\nu_R+\nu_M$ now shows reduced peak-to-peak amplitudes of about 1% of the signal with the frequency $\nu_R$.

The reduced curve (612) is a very flat oscillating curve where the distances between the maxima and minima are extremely small. This will make it obsolete to look for and select minima of the PCD curve in order to achieve a PCD time corresponding to a reduced magnetron orbit. Thus the dependence on the PCD time is practically eliminated. Fast pre-separation methods like liquid chromatography can be used without problems.

Figure 3A:
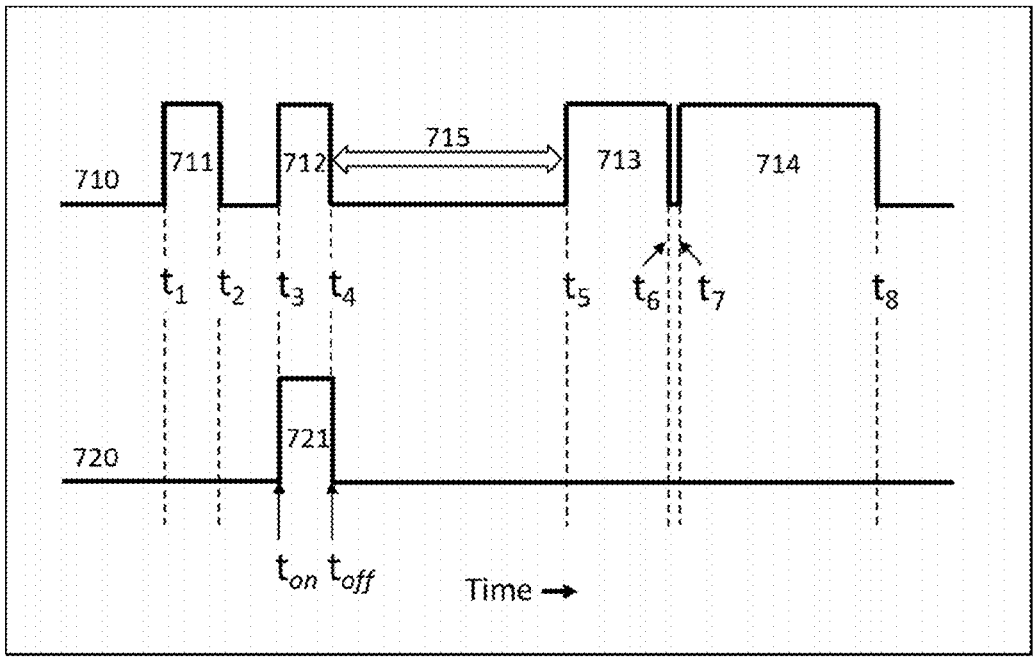
FIGS. 3A-3F show exemplary time sequences for the injection, excitation and detection of ions in the FT-ICR mass spectrometer.
Figure 3B:
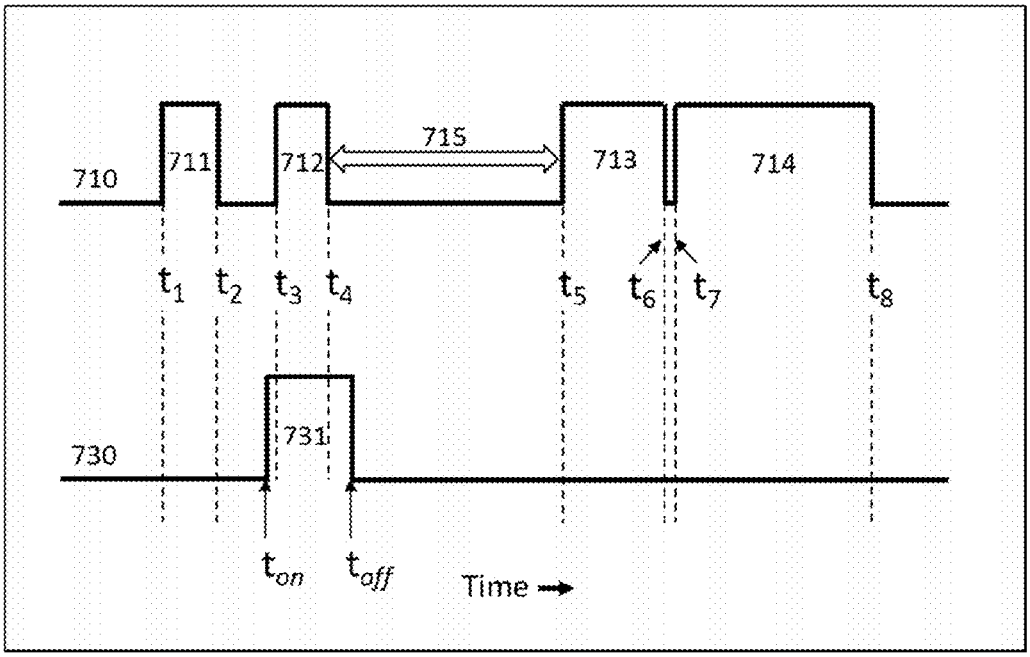
Figure 3C:
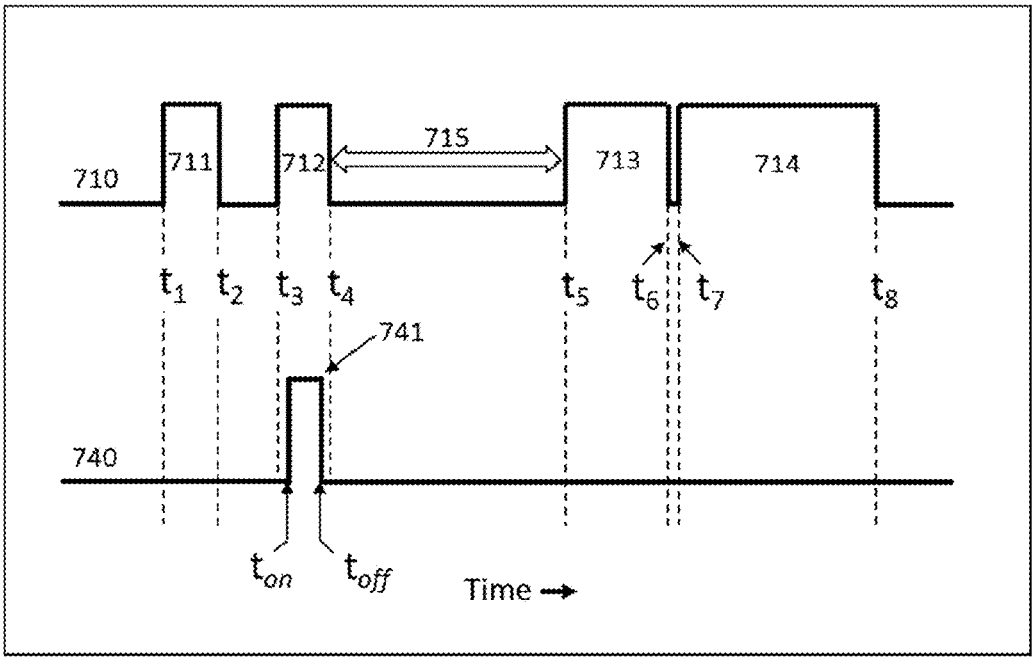
Figure 3D:
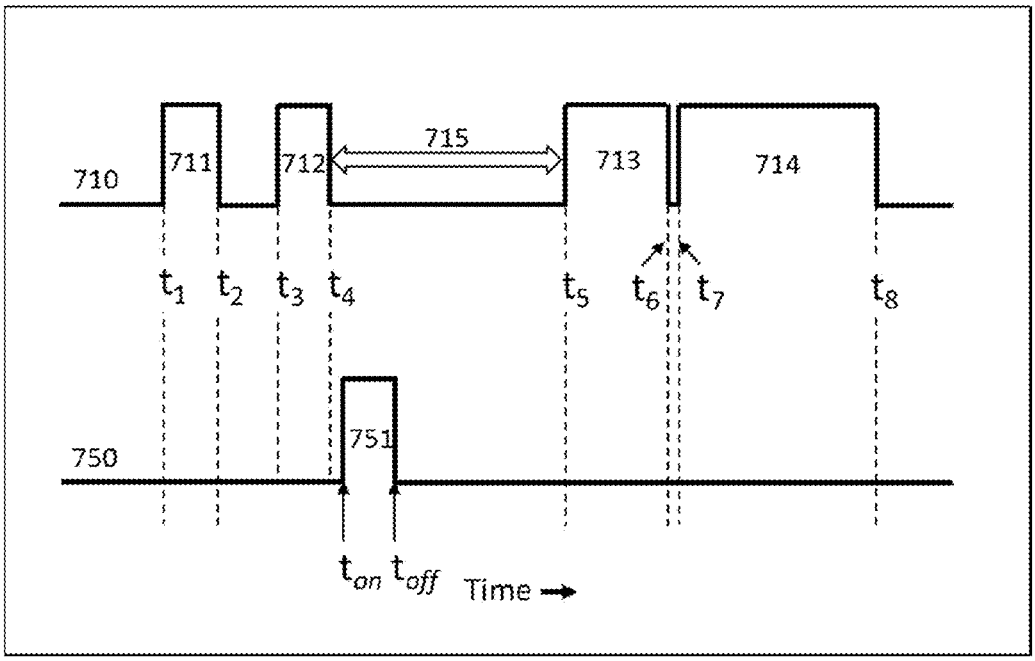
Figure 3E:
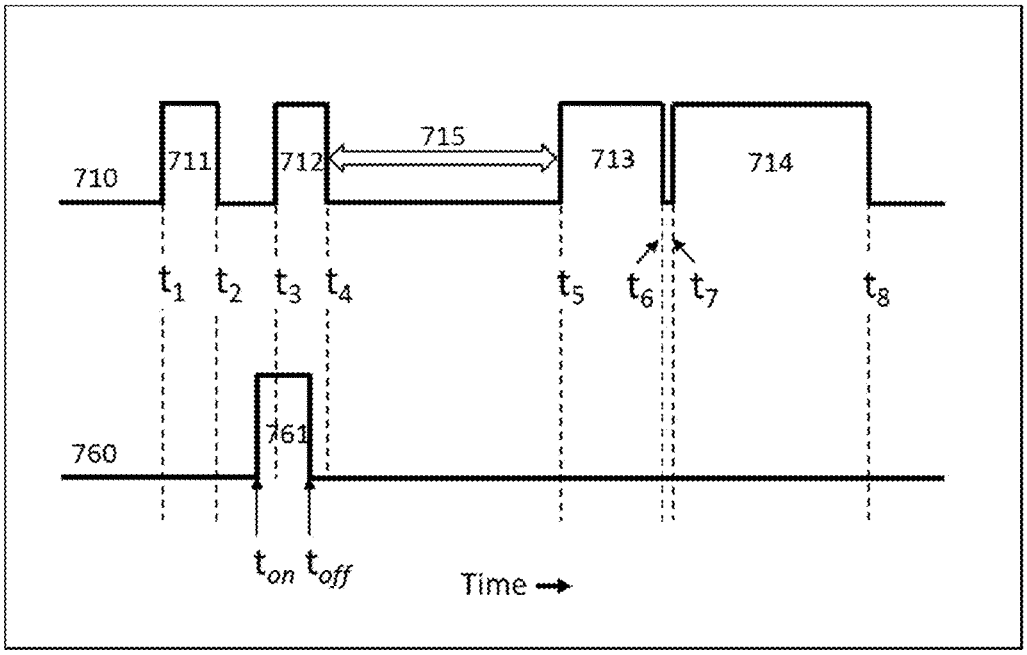
Figure 3F:
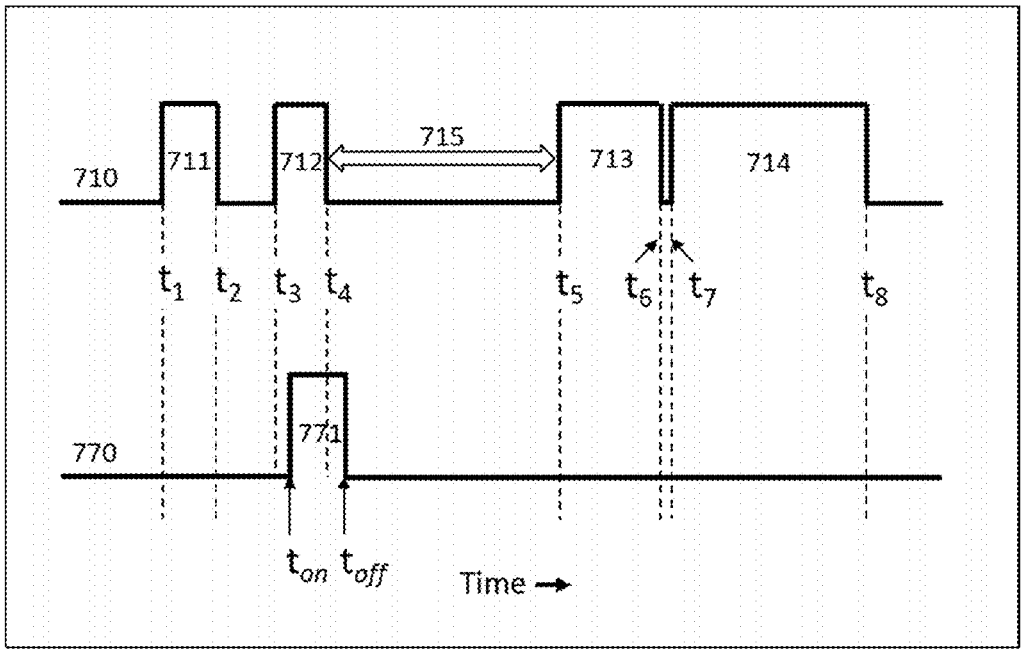

FIG. 3A shows the sequence diagram (710) for the operation of the FT-ICR cell with cell quench (711), ion injection (712), ion excitation (713) and ion detection (714). The cell quench between the time points $t_1$ and $t_2$ cleans the cell from ions of the preceding measurement sequences. The ion injection time (712) is between the time points $t_3$ and $t_4$, the ion excitation pulse (713) is between the time points $t_5$ and $t_6$. After the excitation, the detection of ions (714) is performed between the points $t_7$ and $t_8$. The time between the injection (712) and detection (713) is defined as the post capture delay time (715). The timing diagram of the gated deflection voltages is shown in the plot (720) below. The gated deflection voltage is turned on at $t_{on}$ and turned off at the time $t_{off}$. The gated deflection voltage event (721) normally overlaps with the ion injection event so that all ion species, which reach the ICR cell at different times due to their different m/z value, experience the deflection after their entrance in the ICR cell. But it does not have to exactly coincide with it. However, the gated deflection event can be longer than the ion injection event; for instance, it can start earlier and can end after the ion injection pulse. The plot (730) in FIG. 3B shows the timing diagram of the gated deflection event (731) which starts slightly before the injection period (712) and ends slightly after it. The plot 740 in FIG. 3C shows the timing diagram of the gated deflection event (741) which starts after $t_3$ and ends before $t_4$ so that it is completely within the injection period (712). The timing diagram (750) in FIG. 3D depicts a special case of the gated deflection event (751) which starts after the end of the ion injection event. After the gated deflection event is completed, the DC bias electrodes used for deflection can also be used for electric field correction as described in U.S. patent application Ser. No. 13/767,595.

As described above, ions with different m/z enter the ICR cell at different times during the injection period, i.e., when accelerated to the same kinetic energy lighter ions arrive earlier at the cell, heavier ones fly slower and arrive later. Lighter ions which enter the cell earlier are exposed to the gated deflection voltage for a longer time period than the heavier ions which enter the cell later. The effect of the deflection may therefore be not equal for the m/z range. When the deflection voltage is not constant but varied in time, an equal amount of the deflection force can be applied to the complete m/z range.

A further embodiment of the present invention is the application of gated deflection voltages which can be variable in time. The amplitudes of the individual gated deflection voltages may be varied within the application time of the gated deflection voltage event. Also, the duration of the gated deflection voltage may be varied. Variable gated deflection voltages allow a better control of the ion entrance. This method will work especially well during the injection of larger m/z ranges and longer injection periods. Additionally, by tailoring the variation of the deflection voltage within the gated deflection voltage event, ions in selected mass ranges can be ejected during the ion injection period in order to selectively populate the ICR cell.

The correction voltages for the electrical field axis as well as the gated deflection voltages can be applied to the same mantle electrodes, but at different times. The gated deflection voltage(s) are normally applied during the injection period, but can also start earlier or end after the injection period, so that the ions are deflected to a smaller magnetron orbit after their entrance in the ICR cell. After the gated deflection voltage event, the voltages applied to the mantle electrodes are at the level of the bias voltages for the normal ICR cell operation or at the level of the electric field correction voltage as disclosed in U.S. patent application Ser. No. 13/767,595.

FIG. 4A shows an FT-ICR mass spectrum (500) of a selected second harmonic peak group of a sodium trifluoroacetate (NaTFA) spectrum (m/z 702 peak selected) on a frequency scale, without the electric field asymmetry correction according to U.S. patent application Ser. No. 13/767,595 and without using the gated deflection voltages during ion injection into the FT-ICR cell. Trapping voltages at the end electrodes (80 and 81, FIG. 2A) and the DC bias voltages at the inverse leaf electrodes were all set to 1.5 volts. The peak marked with (502) is the second harmonic peak with the frequency $2\nu_R$ and the one on its left side (503) is the major satellite peak with the frequency $2\nu_R+\nu_M$. The small peaks (504) and (505) on the left are satellites with frequencies $2\nu_R+2\nu_M$ and $2\nu_R+3\nu_M$ and the peak (501) on the right is the one with the frequency $2\nu_R-\nu_M$. The mass difference between peak (502) and peak (503) is only about 5 Hz, corresponding to about 6 mDa.

Figure 4B:
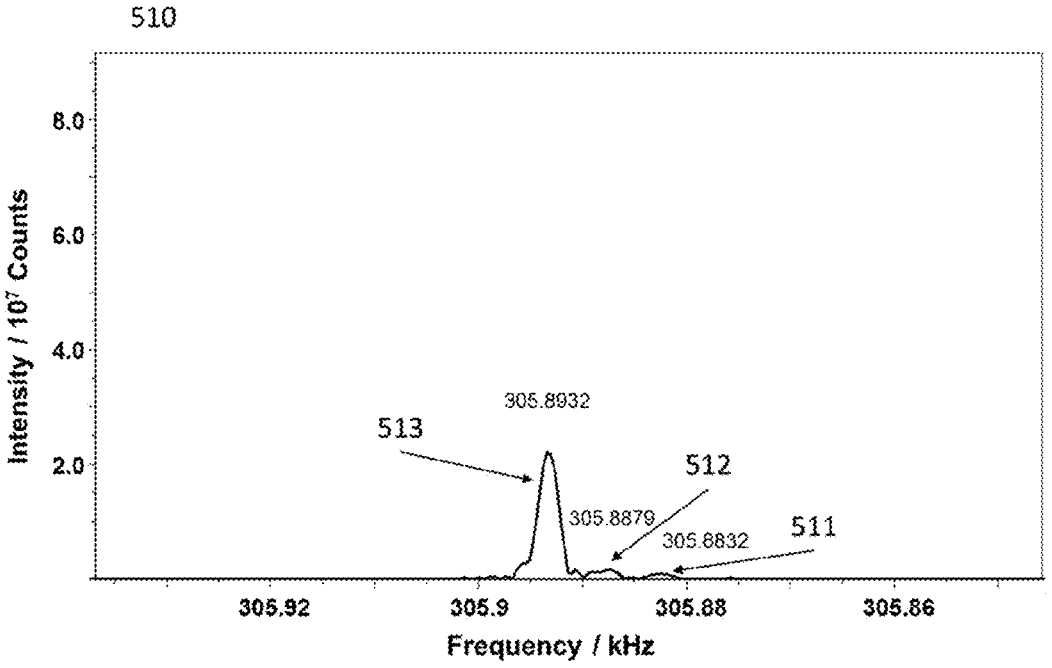
FIG. 4B shows the same peak group of this selected ion after the field correction as described in U.S. patent application Ser. No. 13/767,595.

FIG. 4B shows the FT-ICR mass spectrum (510) of the same peak group as in FIG. 4A (on the same intensity scale) after the electric field asymmetry correction as described in U.S. patent application Ser. No. 13/767,595 but without using the gated deflection voltages. Trapping voltages at the end electrodes (80 and 81, FIG. 2A) is again at 1.5 volts while the DC bias voltages at the inverse leaf electrodes were as follows: The inverse leaf electrode pairs of the two oppositely placed detection sections were both set to 1.5 volts. The inverse leaf electrode pairs of the two oppositely excitation sections were set to 1.555 and 1.445 volts. The resulting field asymmetry correction voltage difference was 10 mV. The peak marked with (512) is the second harmonic peak with the frequency $2\nu_R$, already significantly reduced. On its left side is the major satellite peak with the frequency $2\nu_R+\nu_M$, also reduced in size (513). The small satellites (504) and (505) from FIG. 4A are no longer visible in this spectrum, and the peak (501) from FIG. 4A with the frequency $2\nu_R-\nu_M$ almost disappeared (511).

Figure 4C:
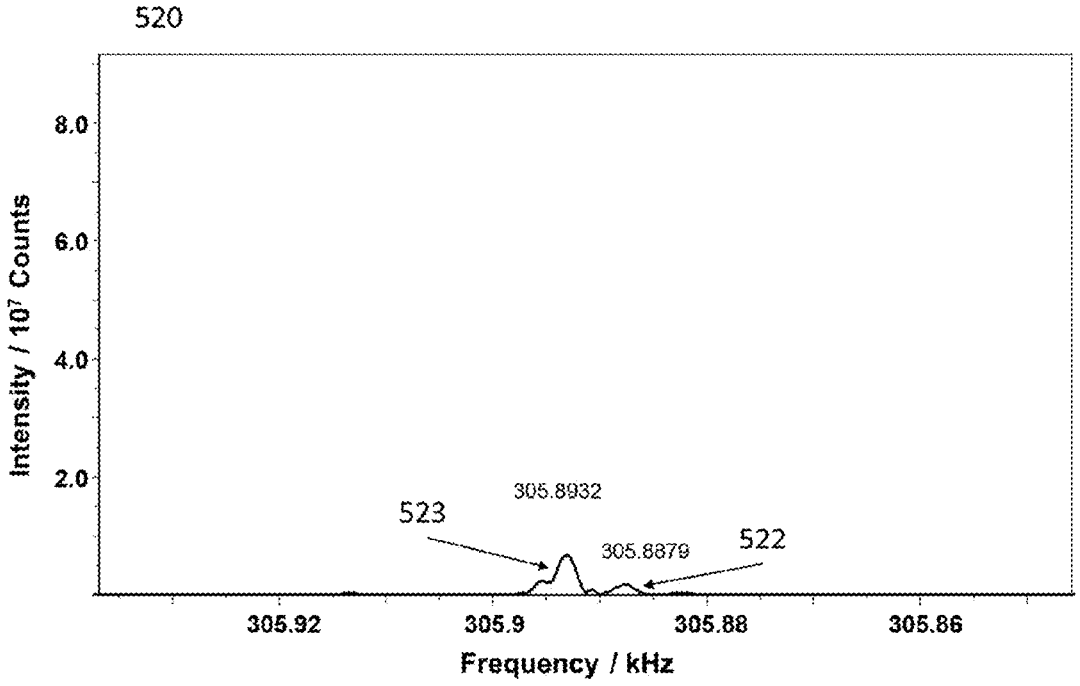
FIG. 4C shows the same peak group of this selected ion after the field correction and the additional reduction of the initial magnetron orbit using the gated deflection voltages introduced by the present invention.

FIG. 4C shows the FT-ICR mass spectrum (520) of the same peak group as in FIGS. 4A and 4B (on the same intensity scale). However, here, the gated deflection voltages are applied during the introduction of ions into the ICR cell for reduction of the initial magnetron orbit size. Trapping voltages were still kept at 1.5 volts. During the ion injection, the DC bias voltages at the inverse leaf electrodes were gated as follows: The inverse leaf electrode pairs of the two oppositely placed detection sections were gated to 1.5 volts (in this case the same as the voltage in the field asymmetry correction voltage as in FIG. 4B). The inverse leaf electrode pairs of the two oppositely excitation sections were gated to 2.0 and 1.0 volts during the injection period of 1 ms. The resulting deflection voltage difference was 1 V. The major satellite peak of the second harmonic ($2\nu_R+\nu_M$) is further significantly reduced (523). This peak is specifically related to the size of the magnetron orbit, thus the significant reduction of this peak's size means the reduction of the magnetron radius. Further reduced is also the second harmonic with the frequency $2\nu_R$ (522).

The process of the magnetron orbit size reduction can be performed starting with static voltage settings at the DC bias electrodes. Conveniently, these static voltage settings can be the voltage settings found for the correction of a field axis shift, as described in U.S. patent application Ser. No. 13/767,595. Initially, an FT-ICR spectrum is acquired and one of the major peaks of interest is chosen as the object (measure) of the optimization. Then, further FT-ICR spectra are acquired under varied post capture delay times until a PCD-diagram for the relative intensity of the satellite peak of an even-numbered harmonics with the frequency of $2n\nu_R\pm m\nu_M$, such as $2\nu_R\pm 1\nu_M$, for over at least two periods of the magnetron motion is completed. It is to be mentioned here that the chosen ion does not have to be isolated for the iteration. Measurements can proceed with all available ions within the ICR cell. The PCD curve shows maxima and minima. A delay time in the PCD diagram at or near a maximum of the curve is selected. Keeping this PCD time, now all (deflection) electrode voltages are varied in a multidimensional search in order to find an optimum voltage combination that leads to a minimum of the relative intensities of the even-numbered harmonics with the frequency $2n\nu_R\pm m\nu_M$, e.g., n=1 and m=1, which is usually the most abounded satellite peak. After finding this local minimum, the obtained voltage values corresponding to this minimum are used and the post capture delay time is varied again, a partial or complete PCD curve is acquired. Then it is checked if the relative intensities of the even-numbered harmonics peaks with the frequencies $n\nu_R\pm m\nu_M$ at the maxima of the curve are reduced below the values obtained with the previous voltage setting. If they are not reduced in this PCD diagram, one has to go back and pick another point near a maximum at the initial PCD curve and start over again. If the relative intensities at the maxima of the curve are reduced, one starts with another iteration step at the new curve's maximum. Again here, a maximum of this PCD curve is selected and the variation of the voltages for a multidimensional search is repeated and optimized again. These iterations are repeated until the global minimum of the even-numbered harmonics with frequencies $2n\nu_R+m\nu_M$ are found.

Alternatively, a reduction of magnetron orbit size can be performed starting with static voltage settings at the mantle electrodes found for the correction of a field axis shift, as described in U.S. patent application Ser. No. 13/767,595 and choosing a starting post capture time delay. Initially, an FT-ICR spectrum is acquired and one of the major peaks of interest is chosen as the object of the optimization. Now all gated DC deflection voltages are varied in a multidimensional search in order to find an optimum voltage combination that leads to a minimum of the relative intensities of the even-numbered harmonics with the frequency $2n\nu_R\pm m\nu_M$, e.g. n=1 and m=1, which is usually the most abounded satellite peak. After finding this local minimum, the obtained voltage values corresponding to this minimum are used and the post capture delay time is varied. With this capture delay time, another multidimensional search for an optimum voltage combination that leads to a minimum of the relative intensities of the even-numbered harmonics with the frequency $2n\nu_R\pm m\nu_M$, e.g., n=1 and m=1, is repeated. The capture delay time can be varied and the search for an optimum voltage combination can be repeated, until a global minimum of the even-numbered harmonics peaks with frequencies ($2n\nu_R\pm m\nu_M$ with n=1, 2, 3, . . . and m=1, 2, 3, . . . ), is found.

The process of the magnetron orbit reduction can be automated. A computer program can be used with an algorithm that begins with the voltage settings at the DC bias electrodes, which are found for the correction of a field axis shift, as described in the patent application U.S. Ser. No. 13/767,595. It acquires FT-ICR spectra, selects one of the major peaks of interest, varies the post capture delay time, acquires again FT-ICR spectra until it completes a PCD-diagram for the relative intensity of the even-numbered harmonics peak with the frequency of $2n\nu_R \pm m\nu_M$, e.g. n=1 and m=1, for over at least two periods of the magnetron motion. The PCD curve shows maxima and minima. The algorithm selects a delay time in the PCD diagram at or near a maximum of the curve. Keeping this PCD time, it now varies all deflection voltages applied to the DC bias electrodes in a multidimensional search to find an optimum voltage combination that leads to a minimum of the relative intensities of the even-numbered harmonics with the frequencies $2n\nu_R \pm m\nu_M$. After finding this local minimum, it uses the obtained voltage values corresponding to this minimum, goes back and varies the post capture delay time, acquires a complete PCD curve, and checks if the relative intensities of the even-numbered harmonics with the frequencies $2n\nu_R \pm m\nu_M$ at the maxima of the curve are reduced below the values obtained with the previous voltage setting. If they are not reduced in this PCD diagram, the program goes back and picks another point near a maximum in the initial PCD curve and starts over again. If the relative intensities at the maxima of the curve are reduced, the program starts another loop at the new curve's maximum. The program again selects a maximum of this PCD curve and repeats the variation of the voltages for a multidimensional search and the optimization again. It repeats these iterative loops until it finds the global minimum of the even-numbered harmonics peak with the frequency, e.g., $2n\nu_R \pm m\nu_M$.

A slightly different method of the optimization, preferably performed in an automated manner, would be the following: The program acquires FT-ICR spectra, selects one of the major peaks of interest and checks the intensities of the even-numbered harmonics peaks ($2n\nu_R \pm m\nu_M$) therein in dependence of the deflection voltages. By independently varying the gated DC deflection voltages at the respective mantle electrodes, the algorithm performs a multidimensional search for a minimum of these peaks. After finding the voltages for obtaining minimal peaks, the algorithm goes back and changes now the post capture delay time, then repeats the multidimensional voltage search again and finds the minimum of the peaks now in dependence of this new delay time, and so on. These iterative loops continue until the global minimum of the even-numbered harmonics with the frequencies $2n\nu_R \pm m\nu_M$ is found.

In the case of segmented deflection electrodes, as shown in FIGS. 8 and 9, the deflection algorithm may include the voltage values of the individual segments of the corresponding electrodes.

Figure 5A:
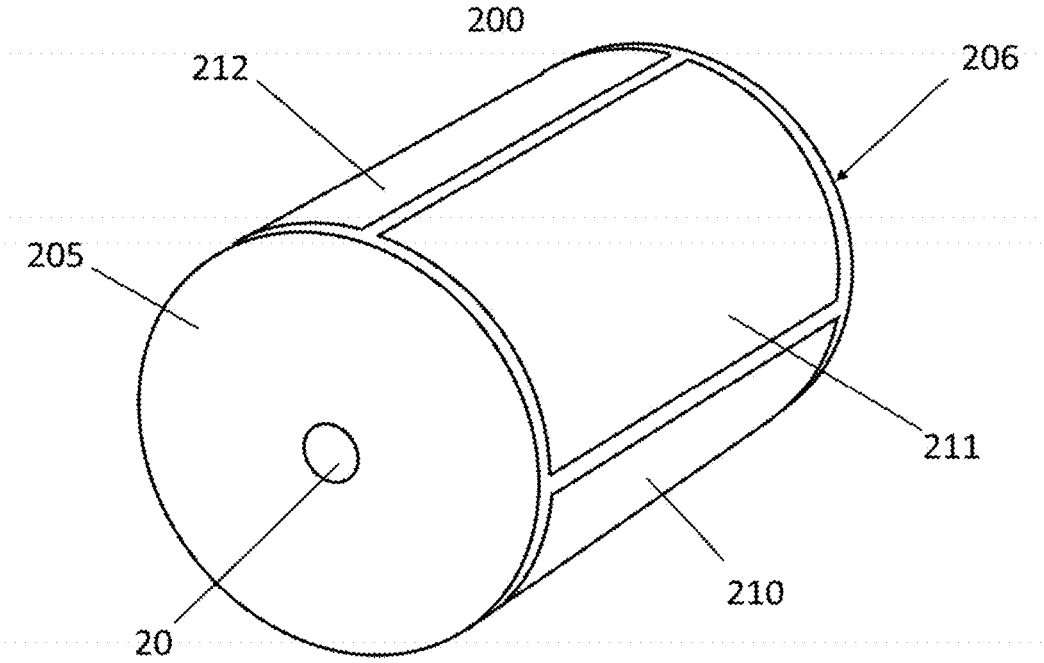
FIG. 5A shows a conventional cylindrical FT-ICR cell with two excitation electrodes and two detection electrodes as well as two end electrodes for axial trapping.
Figure 5B:
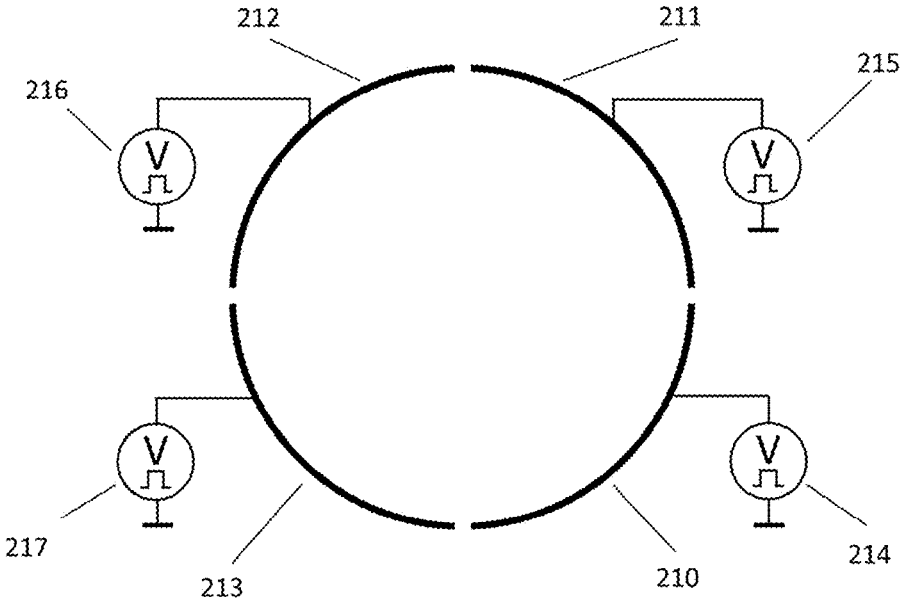
FIGS. 5B and 5C show example schematics of the connection of the gated DC voltage supplies.

Such an optimization program can always be applied when a magnetron orbit reduction is required. Automated runs can also be implemented for diagnostic purposes. Here the program would acquire in periodic times a post capture delay curve just for testing the diameter of the magnetron orbit The present invention of deflection by DC voltage gating during the ion injection for reduction of the magnetron radius can also be applied to conventional cylindrical ICR cells, as shown at (200) in FIG. 5A. In these cells, according to further embodiments of the invention, the magnetron orbit reduction can be performed by connecting variable voltages to at least one of the excitation electrodes (one of them visible, 211) and/or to at least one of the detection electrodes (210 and 212). Detection electrodes are usually sensitive and often generate a noisy signal if a DC voltage is applied to them. However, if a battery is used as power source, for example, the noise can be minimized, also in this case due its very stable output. FIG. 5B depicts a simplified wiring scheme for the connection of gated DC voltage sources including a cross-sectional view of the cell 200 shown in FIG. 5A. Four independent gated DC voltage sources 214, 215, 216, and 217 are connected to the mantle electrodes 210, 211, 212, and 213 respectively. An alternative embodiment shown in FIG. 5C uses only two gated DC voltage sources 218 and 219 which generate a differential voltage between two oppositely placed mantle electrodes 211, 213 and 210, 212 respectively. The electrodes 211 and 213 are excitation electrodes, 210 and 212 are detection electrodes.

Figure 6A:
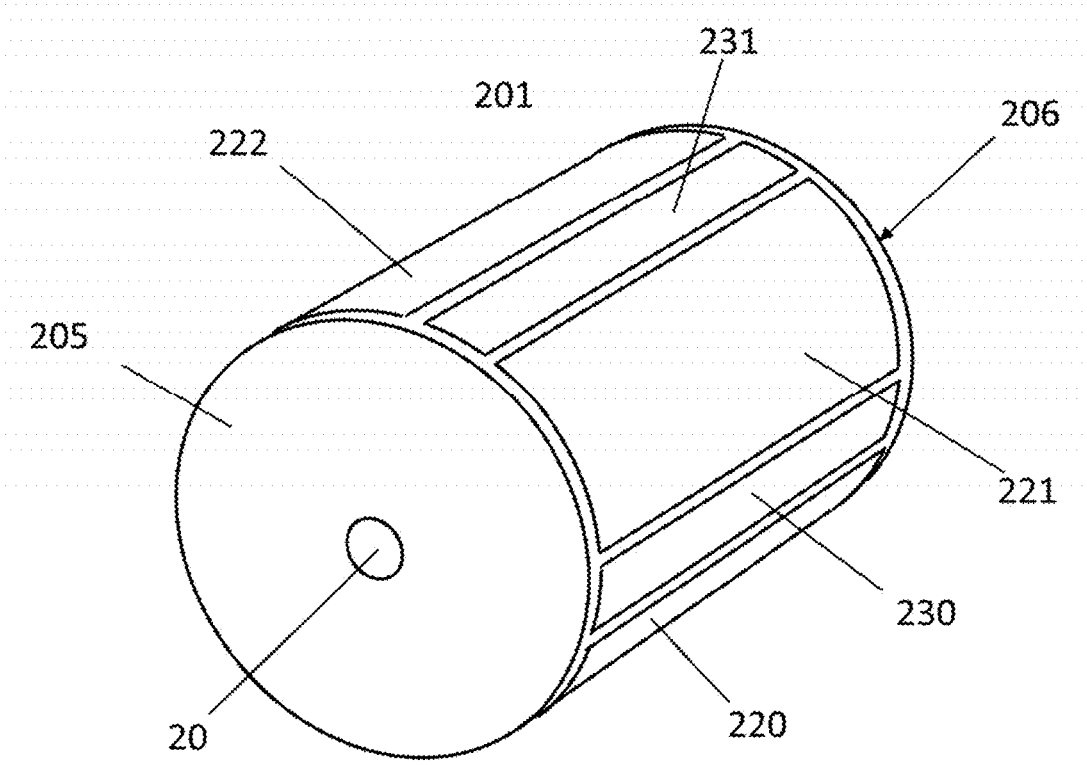
FIG. 6A depicts a modified conventional cylindrical cell in which a correction electrode is placed between each excitation and detection electrode of the cylinder mantle.
Figure 6B:
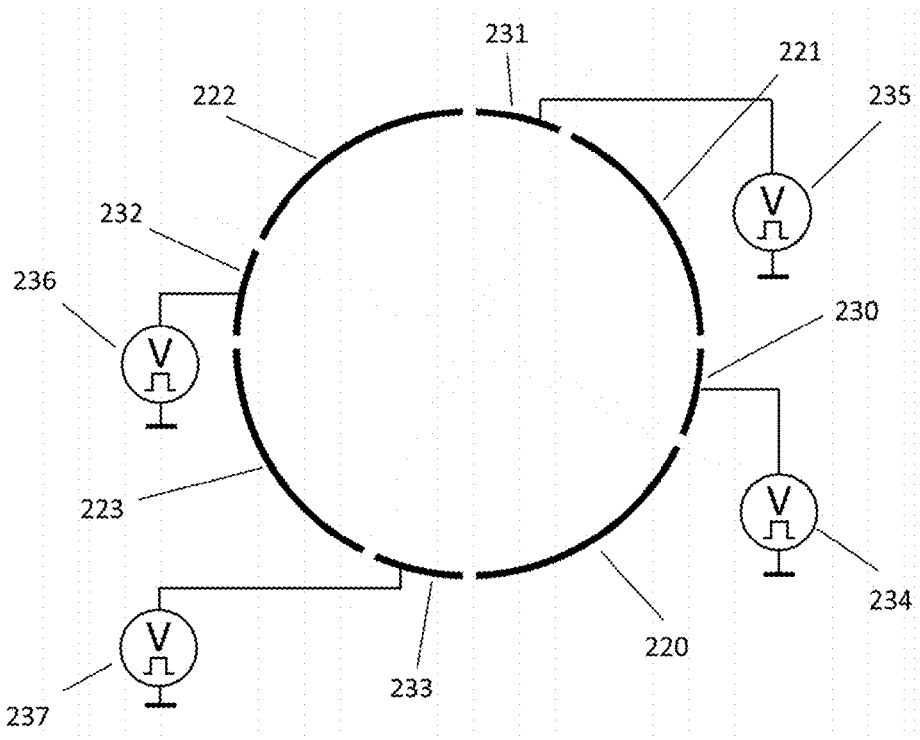
FIGS. 6B and 6C show example schematics of the connection of the gated DC voltage supplies.
Figure 6C:
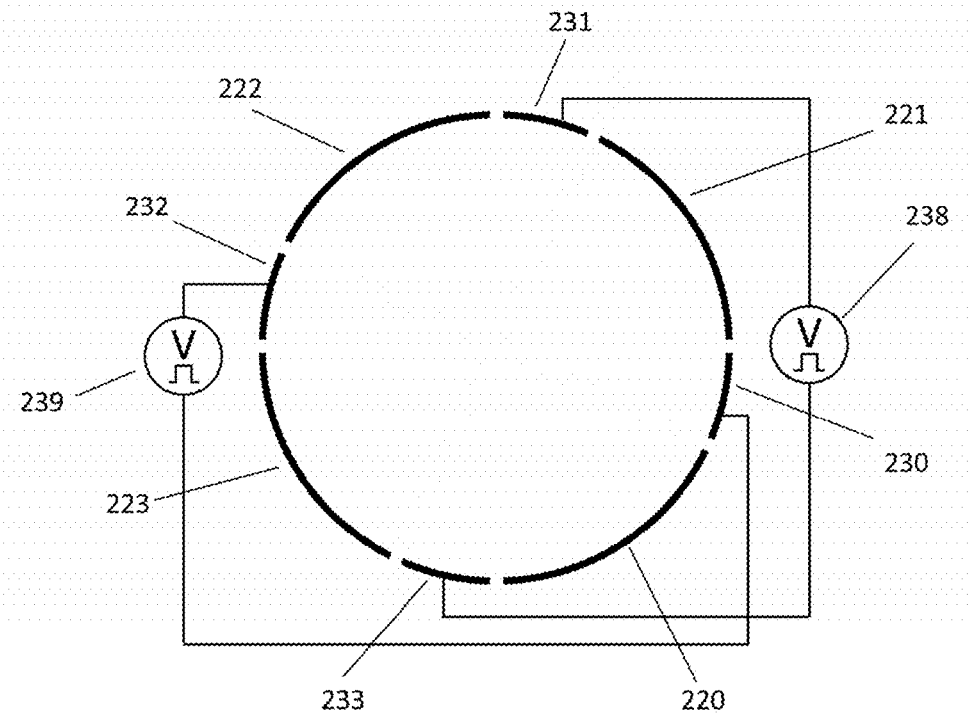

Another alternative embodiment according to the invention comprises modifying a conventional cylindrical ICR cell with additional electrodes that carry the necessary DC bias voltages. The embodiment in FIG. 6A shows such a cylindrical cell (201) with a total of four longitudinal deflection electrodes (e.g., 230 and 231) between excitation electrodes (one of them visible, 221) and detection electrodes (220 and 222). FIG. 6B depicts a simplified wiring scheme for the connection of gated DC voltage sources including a cross-sectional view of the cell 201 shown in FIG. 6A. Four independent gated DC voltage sources 234, 235, 236, and 237 are connected to the additional longitudinal mantle electrodes 230, 231, 232, and 233 respectively. FIG. 6C uses only two gated DC voltage sources 238 and 239 which generate a differential voltage between two oppositely placed mantle electrodes 231, 233 and 230, 232 respectively. The mantle electrodes 221 and 223 are excitation electrodes, 220 and 222 are detection electrodes.

Figure 7A:
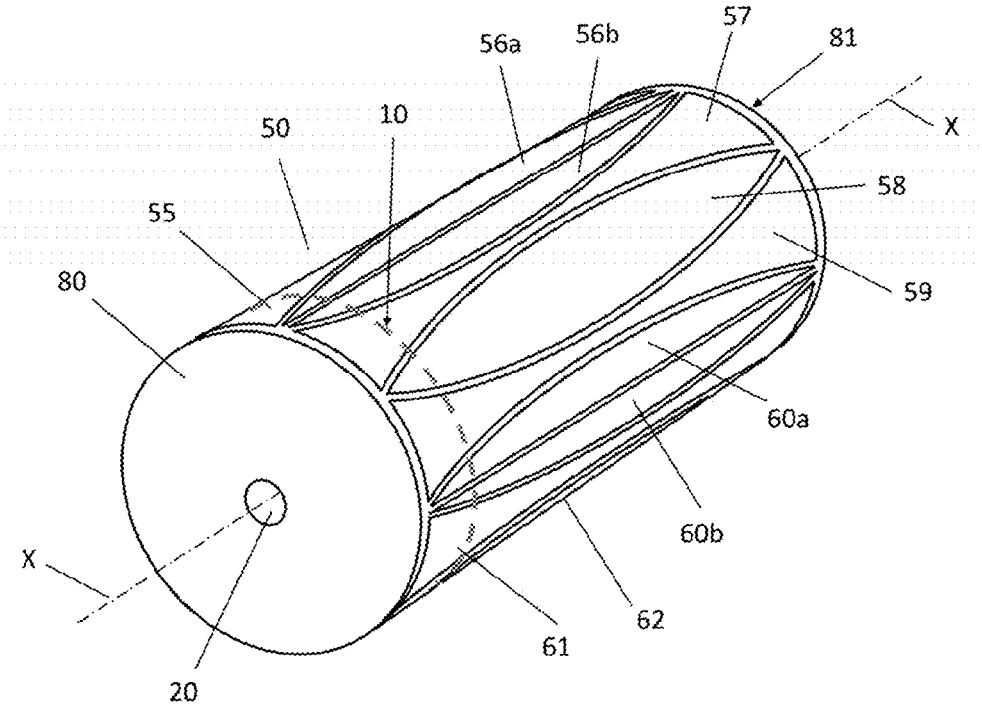
FIGURE 7A (PRIOR ART)
FIG. 7A presents a dynamically harmonized ICR cell with eight leaf shaped (integral and split) and eight inverse leaf shaped electrodes.
Figure 7B:
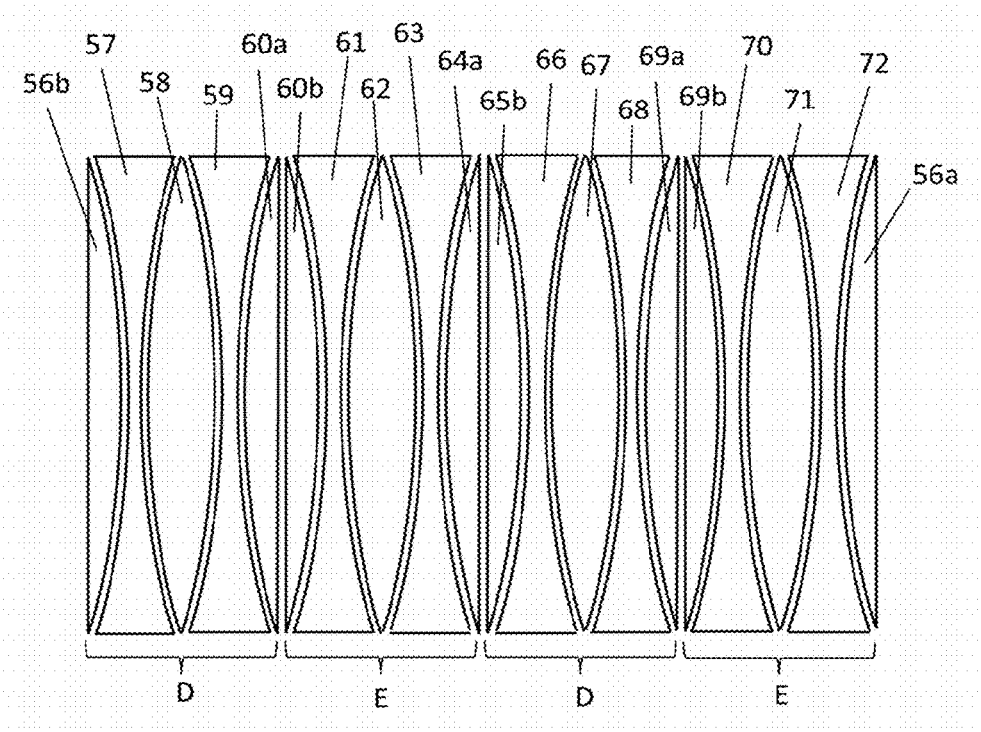
FIGURE 7B (PRIOR ART)
FIG. 7B depicts the unwound mantle electrodes.
Figure 7C:
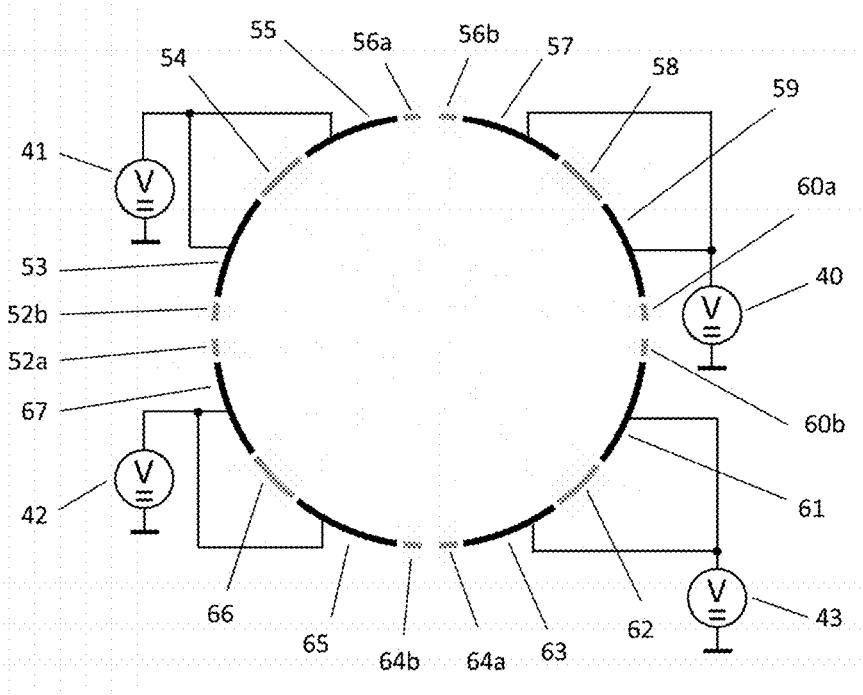
FIGURE 7C (PRIOR ART)
FIG. 7C shows individual static DC voltage sources connected to the inverse leaf electrode pairs according to U.S.

As a dynamically harmonized ICR cell contains mantle electrodes where a DC voltage is applied (shown in FIGS. 7A-7C), it can easily be used for the present invention. In this case, the four independent DC voltage sources 68, 69, 70, and 71 shown in FIG. 7C are gated DC voltage sources. Each gated DC voltage source is connected to a pair of inverse leaf electrodes: The source 69 to electrodes 53 and 55, the source 68 to electrodes 57 and 59, the source 71 to electrodes 61 and 63, the source 70 to electrodes 65 and 67. An alternative embodiment shown in FIG. 7E uses only two gated DC voltage sources (72 and 73) which generate a differential voltage between two oppositely placed inverse leaf electrode pairs. The source 72 is connected to the electrode pair 57, 59, and 65, 67. The source 73 is connected to the electrode pair 53, 55, and 61, 63.

In some cases FT-ICR cells with a larger number of excitation and/or detection electrodes are used. Using multiple pairs of detection electrodes for multiple frequency detection helps acquire higher resolution FT-ICR spectra. In the cells for these applications also a larger number of mantle electrodes provided with gated DC voltages can be used. In an FT-ICR cell with four excitation and four detection electrodes, also eight additional mantle electrodes can be placed between each of these FT-ICR excitation and detection electrodes. Even if the cell is not used for higher frequency detection, excitation and detection electrodes can still be divided longitudinally into two or more parts and a thin longitudinal DC bias electrode can be placed between each of them.

Figure 5C:
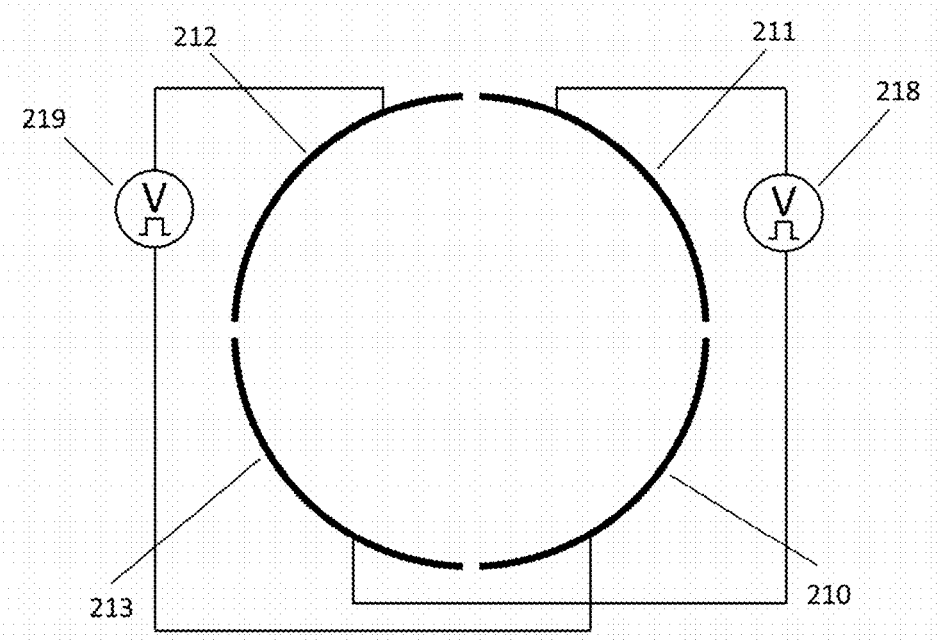
Figure 7D:
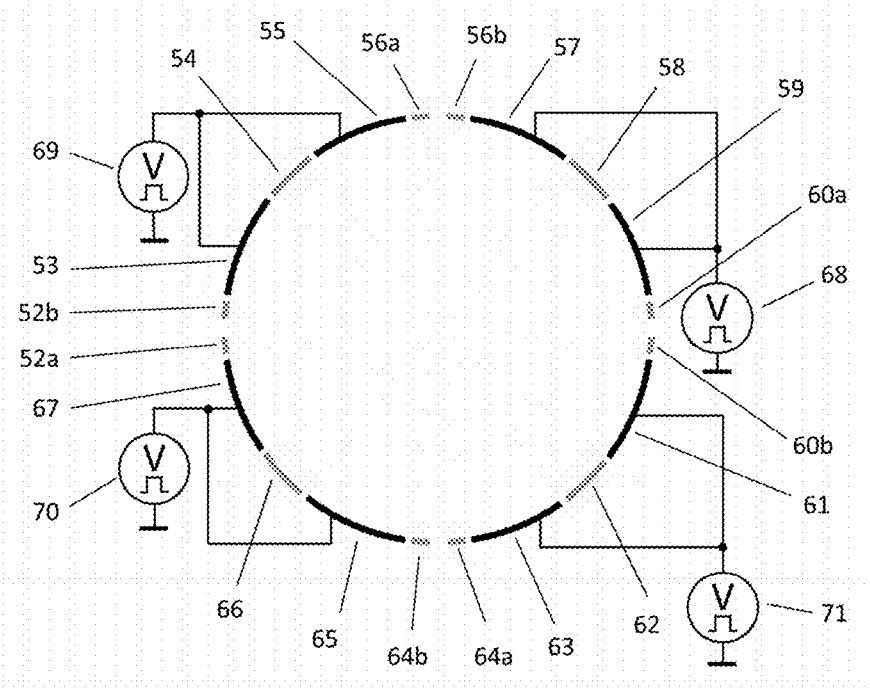
FIGS. 7D and 7E show two example schematics of the connection of the gated DC voltage supplies according to the present invention.
Figure 7E:
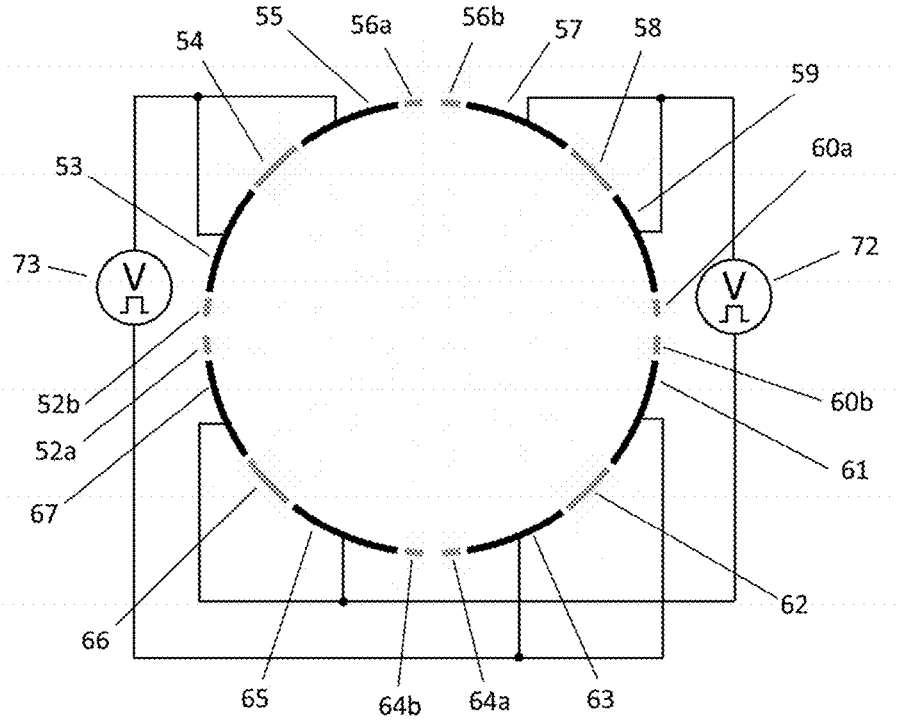
Figure 8A:
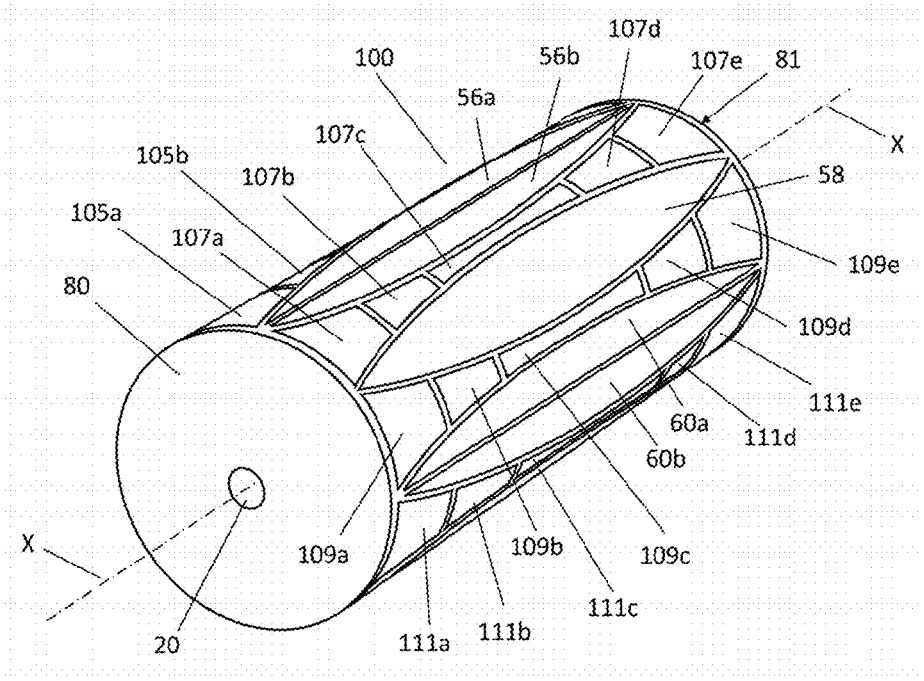
FIG. 8A depicts a dynamically harmonized ICR cell modified according to an embodiment as described in U.S. patent application Ser. No. 13/767,595 by longitudinally dividing each inverse leaf electrode into five segments in order to be able to also correct axial components of the electric field disturbance.

The present invention can also be applied to ICR cells that use segmented DC bias electrodes as described in U.S. patent application Ser. No. 13/767,595. According to another embodiment of the invention as shown in FIG. 8A, a modified dynamically harmonized ICR cell (100) in which the inverse leaf shaped cylinder mantle electrodes are divided. Divided inverse leaf electrodes visible in this figure consist of the partial electrodes (107*a*), (107*b*), (107*c*), (107*d*), (107*e*), and (109*a*), (109*b*), (109*c*), (109*d*), and (109*e*), as well as (111*a*), (111*b*), (111*c*), (111*d*), (111*e*). Only two partial electrodes (105*a*) and (105*b*) are visible from a further inverse leaf electrode family (105*a*-105*e*). As an example, each of these inverse leaf partial electrodes can be connected to an individual gated DC voltage source in FIG. 8B. For the sake of clarity not all gated DC voltage sources for every row of partial electrodes are depicted here. The partial electrodes 107*a-e* are connected to gated DC voltage sources 117*a-e*, respectively. Similarly, partial electrodes 109*a-e* are connected to gated DC voltage sources 119*a-e*, respectively. The partial electrodes 111*a-e*, as well as 105*a-e*, which are visible in this figure are also connected to individual gated DC sources, these sources are not depicted in this figure. Amplitudes of the gated DC voltages and their pulse durations of all DC voltage sources can be individually tuned. As shown in FIGS. 5C, 6C and 7D, also two sets of differential gated DC voltage sources is possible here. Analogous to the configuration in FIG. 7C, the partial electrodes of adjacent inverse leaf electrodes can be paired so that to each pair of partial electrodes one single gated DC voltage source is connected.

Figure 8B:
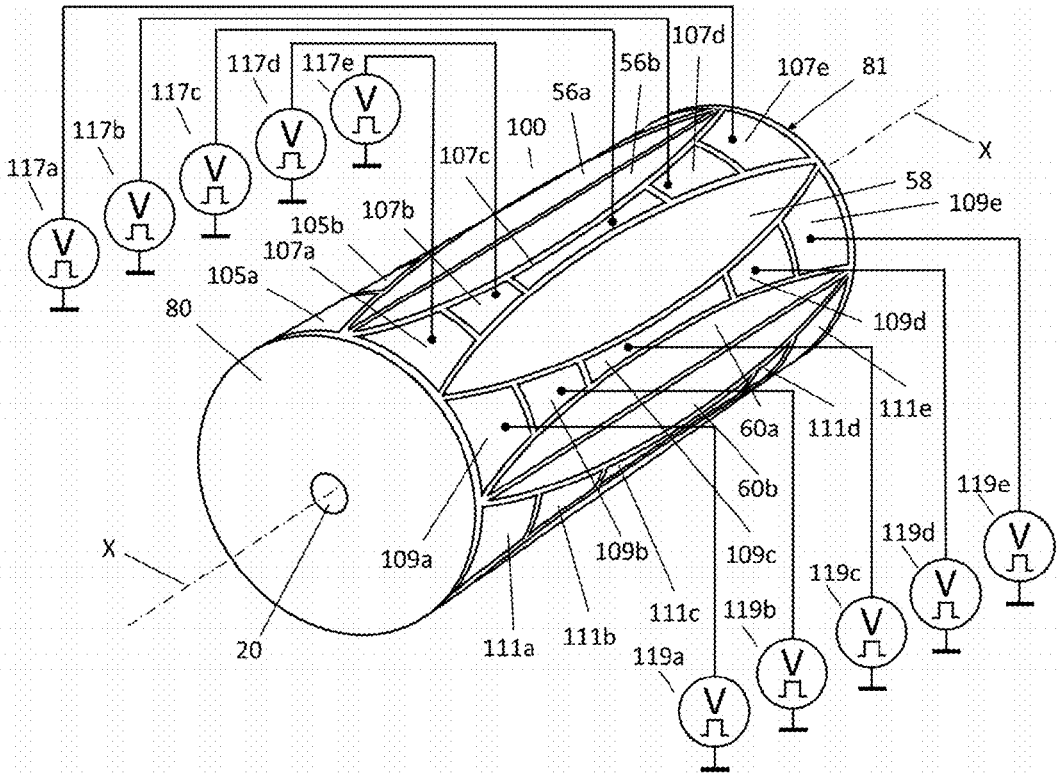
FIG. 8B shows an example schematic of the connection of the gated DC voltage supplies.

The configuration depicted in FIGS. 8A and 8B is one of the possible embodiments and comprises inverse leaf electrodes divided in five parts. Inverse leaf electrodes comprising more parts can be made. In this configuration leaf electrodes (e.g., 58) as well as the half-leaf electrodes (e.g., 56*a* and 56*b*) remain unchanged compared to the original version of the dynamically harmonized ICR cell (50) shown in FIG. 7A.

Figure 9A:
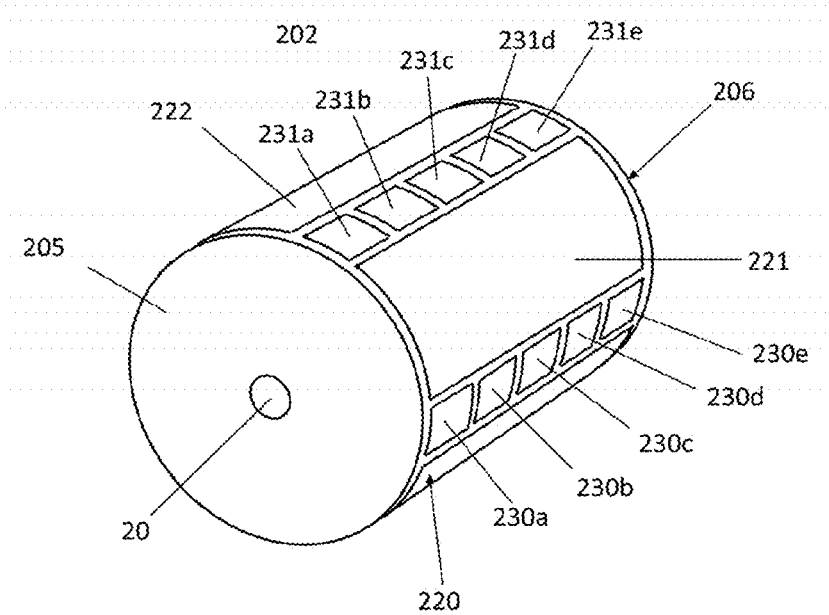
FIG. 9A shows a modified cylindrical cell according to an embodiment as described in U.S. patent application Ser. No. 13/767,595 in which correction electrodes between the excitation and detection electrodes are longitudinally divided each into five segments in order to be able to also correct axial components of the electric field disturbances.
Figure 9B:
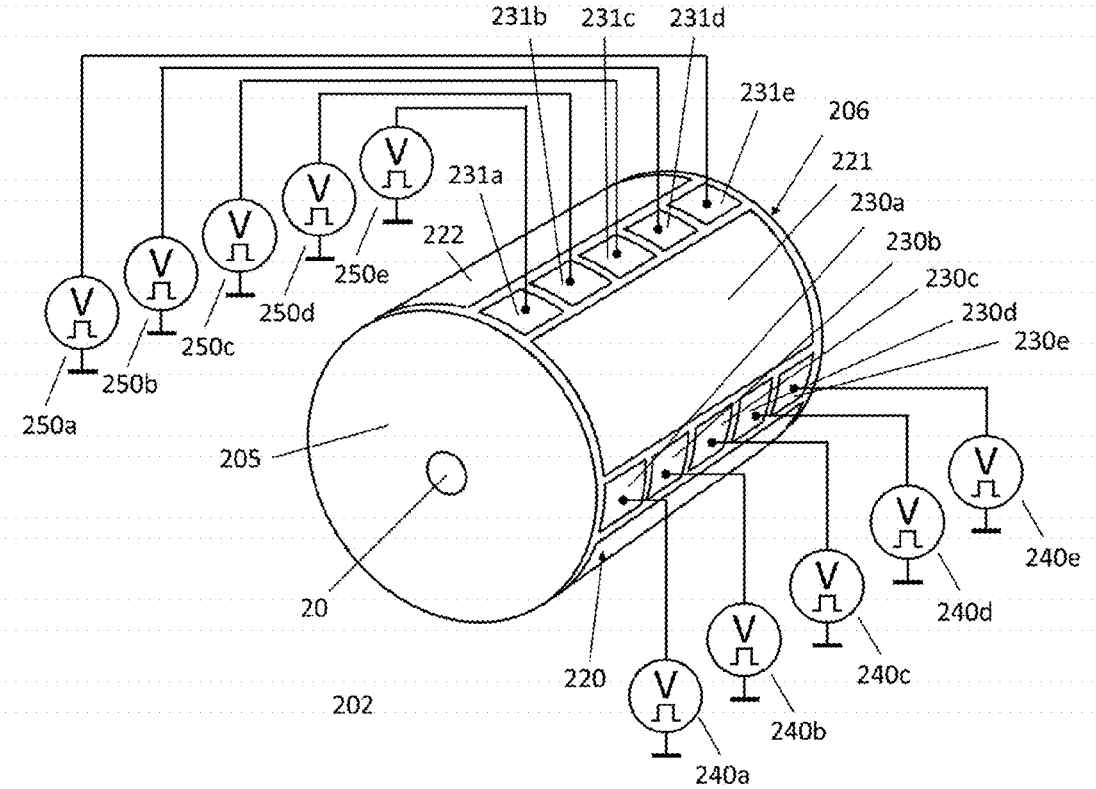
FIG. 9B shows an example schematic of the connection of the gated DC voltage supplies.

A further modified ICR cell (202) is shown in FIG. 9A as another embodiment according to the invention. As an example, each of these partial electrodes can be connected to an individual gated DC voltage source in FIG. 9B. For the sake of clarity, not all gated DC voltage sources for every row of partial electrodes are depicted here. The partial electrodes 230*a-e* are connected to gated DC voltage sources 240*a-e*, respectively. Similarly, partial electrodes 231*a-e* are connected to gated DC voltage sources 250*a-e*, respectively. The other partial electrodes not visible in this figure are also connected to individual gated DC voltage sources; these sources are not depicted here. Amplitudes of the gated DC voltages and their pulse durations of all DC voltage sources can be individually tuned. As shown in FIGS. 5C, 6C and 7D, also two sets of differential gated DC voltage sources are possible here. The number of electrode segments is not limited to the number five as in this embodiment but can be varied.

The invention has been described with reference to various embodiments. It will be understood, however, that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims.

The invention claimed is:

1. A method for injecting ions into an ICR cell with mantle electrodes arranged along the axis of the cell, wherein a gated DC voltage is applied to a mantle electrode of the ICR cell such that injected ions are deflected inside the ICR cell in a radial direction, so as to reduce the magnetron motion of the ions.

2. The method according to claim 1, wherein the gated DC voltage is applied prior to a cyclotron excitation of the injected ions.

3. The method according to claim 2, wherein the duration of the gated DC voltage partially or fully overlaps with the injection period of the ions into the ICR cell.

4. The method according to claim 2, wherein the gated DC voltage is applied after the injection of the ions into the ICR cell and prior to the cyclotron excitation of the ions.

5. The method according to claim 1, wherein at least two gated DC voltages are each applied to different mantle electrodes such that the deflection of the injected ions is adaptable to any radial direction.

6. The method according to claim 5, wherein the ICR cell is a dynamically harmonized ICR cell with leaf and inverse leaf electrodes, and wherein the at least two gated DC voltages are applied to different inverse leaf electrodes.

7. The method according to claim 5, wherein the gated DC voltages are applied to mantle electrodes which are separated by parallel and optionally azimuthal slits from adjacent mantle electrodes.

8. The method according to claim 5, wherein the at least two gated DC voltages applied to mantle electrodes are adjusted such that the signal intensity of at least one even-numbered harmonic peak with the frequencies of $2nv_R \pm mv_M$ (with n=1, 2, 3, . . . and m=1, 2, 3, . . . ) becomes minimal.

9. The method according to claim 8, wherein the signal intensity of at least one even-numbered harmonic peak with the frequencies of $2nv_R \pm mv_M$ (with n=1, 2, 3, . . . and m=1, 2, 3, . . . ) is reduced by varying a post capture delay time prior or after adjusting the gated DC voltages.

10. The method according to claim 1, wherein the amplitude of at least one gated DC voltage is varied within the duration of the at least one gated DC voltage.

11. An ICR cell with mantle electrodes arranged along the axis of the cell, comprising at least two gated DC voltage sources that are each connected to different mantle electrodes and that are configured to generate a radial deflection field inside the cell and to remove the deflection field prior to the excitation of the ions, so as to reduce the magnetron motion of the ions.

12. The ICR cell according of claim 11, wherein the ICR cell is a dynamically harmonized ICR cell with leaf and inverse leaf electrodes and wherein the gated DC voltage sources are each connected to different inverse leaf electrodes.

13. The ICR cell according to claim 11, wherein the ICR cell is a dynamically harmonized ICR cell with leaf and inverse leaf electrodes, at least one inverse leaf electrode being segmented longitudinally, and wherein one of the gated DC voltage sources is connected to a segment of the inverse leaf electrode.

14. The ICR cell according to claim 12, wherein adjacent inverse leaf electrodes or longitudinal segments of adjacent inverse leaf electrodes are electrically connected to groups and wherein each group is jointly connected to one of the gated DC voltage sources.

15. The ICR cell according to claim 11, wherein the ICR cell comprises excitation and detection electrodes and wherein a first gated DC voltage sources is connected to one or all excitation electrodes and a second gated DC voltage is connected to one or all detection electrodes.

* * * * *